United States Patent [19]

Iwaki et al.

[11] Patent Number: 4,949,134

[45] Date of Patent: Aug. 14, 1990

[54] IMAGE FORMING APPARATUS HAVING INTERMEDIATE TRAY

[75] Inventors: Hiroshi Iwaki, Ichinomiya; Yoshiharu Mita, Himeji; Akihiko Suto, Gifu; Shinichi Kikkawa, Ogaki; Yasushi Handa; Sadaki Kodera, both of Gifu, all of Japan

[73] Assignee: Sanyo Electric Co., Ltd., Osaka, Japan

[21] Appl. No.: 319,636

[22] Filed: Mar. 6, 1989

[30] Foreign Application Priority Data

| | | | |
|---|---|---|---|
| Mar. 3, 1988 | [JP] | Japan | 63-28427 |
| Mar. 9, 1988 | [JP] | Japan | 63-55272 |
| Mar. 10, 1988 | [JP] | Japan | 63-56939 |
| Mar. 10, 1988 | [JP] | Japan | 63-32073[U] |
| Mar. 14, 1988 | [JP] | Japan | 63-60802 |
| Mar. 15, 1988 | [JP] | Japan | 63-33922[U] |
| Mar. 19, 1988 | [JP] | Japan | 63-66151 |
| Apr. 6, 1988 | [JP] | Japan | 63-84435 |

[51] Int. Cl.[5] ..... G03G 15/00

[52] U.S. Cl. ..... 355/317; 355/319; 355/24; 271/238; 271/240; 271/253

[58] Field of Search ..... 355/317, 309, 308, 23, 355/24, 319; 271/226, 230, 234, 236, 238, 239, 240, 248, 253

[56] References Cited

U.S. PATENT DOCUMENTS

| | | | |
|---|---|---|---|
| 4,519,700 | 5/1985 | Barker et al. | 355/317 X |
| 4,673,279 | 6/1987 | Brown | 355/317 X |
| 4,734,738 | 3/1988 | Yamanaka et al. | 355/24 X |
| 4,799,084 | 1/1989 | Koike et al. | 355/317 |
| 4,823,159 | 4/1989 | Yamamoto et al. | 355/317 |

*Primary Examiner*—R. L. Moses

*Attorney, Agent, or Firm*—Darby & Darby

[57] ABSTRACT

An image forming apparatus includes an intermediate tray wherein a copied paper on which an image has been formed is stored. In the case of a double-face copy, the copied paper is stored in the intermediate tray in a manner that a surface on which an image has been formed is faced upward and, in the case of a multi-copy, the copied paper is stored in the intermediate tray in a manner that a surface on which an image has been formed is faced downward. The intermediate tray has two movable guide members which sandwiches the copied paper stored in the intermediate tray in a width direction thereof. The movable guide members are moved so as to go and come back once at every timing when a sheet of copied paper is stored in the intermediate tray, whereby both side ends of the copied paper are pushed by the movable guide members to be aligned. The movable guide members are returned to respective home positions at every timing when ten copied papers are stored in the intermediate tray, whereby an accumulative error of the movement of the movable guide members can be corrected. In addition, a center position between the two movable guide members can be electrically corrected by moving respective reference positions of the movable guide members in the same direction at the same amount.

26 Claims, 23 Drawing Sheets

110

MAGNIFICATION DISPLAY 136
QUANTITY DISPLAY 120

IMAGE FORMING APPARATUS HAVING INTERMEDIATE TRAY

BACKGROUND OF THE INVENTION

1. Field of the invention

The present invention relates to an image forming apparatus. More specifically, the present invention relates to an image forming apparatus having an intermediate tray wherein a copied paper on which an image has been formed is temporarily stored and the copied paper is supplied again from the intermediate tray to an image forming portion, whereby a so-called "double-face copy" or "multi-copy" can be performed.

2. Description of the prior art

In an image forming apparatus in which a double-face copy and/or multi-copy can be performed, a paper on which a copy image has been formed (hereinafter, simply called as "copied paper") is temporarily stored in an intermediate tray, and thereafter, the copied paper is sent from the intermediate tray to an image forming portion, that is, a photosensitive drum. If the copied paper is accommodated or stored in the intermediate tray in a manner that both side ends of the copied paper are not aligned, an image cannot be formed at an accuracy position in the following image forming operation. Therefore, a means for aligning the copied paper stored in the intermediate tray is disclosed in, for example, Japanese patent application Laid-open No. 162760/1981 laid open on Dec. 14, 1981 and Japanese Patent Publication No. 42823/1987 published on Sept. 10, 1987. In the former, movable guide members are provided at both sides in a width direction of the copied paper and, by reciprocating the movable guide members, the both side ends of the copied paper can be aligned. In the latter, such movable guide members can be changed in position in accordance with a paper size and, by reciprocating one of the movable guide members, the both side ends of the copied paper can be aligned.

However, in the prior art, a moving stroke of the movable guide members cannot be constant and is changed depended on the accuracy of a driving source of the movable guide members or a communicating system of a driving force from the driving source. If the moving stroke of the movable guide members is not constant, the alignment of the both side ends of the copied paper cannot be surely performed, and thus, a shear in forming an image occurs. In order to be constant the moving stoke of the movable guide members by correcting an accumulative error of the movement of the movable guide members, it is considerable that the movable guide members are forcedly returned to the respective home positions for each alignment operation. However, in this case, it takes much time for reciprocating the movable guide members to align the copied paper, and therefore not effective.

SUMMARY OF THE INVENTION

Therefore, a principal object of the present invention is to provide a novel image forming apparatus which has an intermediate tray provided with movable guide members for aligning both side ends of a copied paper being stored in the intermediate tray.

Another object is to provide an image forming apparatus in which an accumulative error of movement of movable guide members can be effectively corrected.

Another object of the present invention is to provide an image forming apparatus in which a center position between two movable guide members, that is, a center position in a width direction of a copied paper being stored in an intermediate tray can be corrected.

Another object of the present invention is to provide an image forming apparatus having an improved mechanism by which a paper occurring a jam at a portion of an intermediate tray and their relative portions can be simply removed.

Another object of the present invention is to provide an image forming apparatus in which even if a size of a copied paper is different from each other, the copied paper can be positioned in an intermediate tray with accuracy.

The other object of the present invention is to provide an image forming apparatus which can be prevent a paper from being jamed in an intermediate tray and their relative portions as much as possible.

An image forming apparatus in accordance with the present invention comprises image forming means; first paper supplying means for supplying a paper on which no image has been formed (hereinafter, simply called as "coping paper") to the image forming means; an intermediate tray for temporarily storing a copied paper on which an image has been formed by the image forming means; second paper supplying means for supplying again the copied paper from the intermediate tray to the image forming means; two movable guide members provided in association with the intermediate tray for aligning both side ends of the copied paper being stored in the intermediate tray; input means for inputting data for correcting divergence of a center position between the two movable guide members; and changing means for changing reference positions of the two movable guide members based upon the data.

When the movable guide members respectively exist at the reference positions, for example, home positions, the changing means corrects data of the reference positions in accordance with the above described data. For example, when the movable guide members are moved by stepping motors, if the data is set as that the reference positions of the two movable guide members should be deviated or shifted in the same direction at the same step numbers, the center position between the two movable guide members can be deviated or shifted in the direction by the same step numbers.

In accordance with the present invention, even if the center position between the movable guide members, that is, the center position of the copied paper being accommodated or stored in the intermediate tray is deviated by any cause, without the mechanical changing of the positions of the movable guide members, it is possible to simply correct such divergence of the center position.

In one embodiment, there is provided with one or two movable guide members which are contacted with one or both side ends of the copied paper at every timing when a sheet of the copied paper is stored in the intermediate tray, whereby an alignment of the side ends of the copied paper can be performed. In this embodiment, at every predetermined time interval, for example, at every timing when a predetermined two or more number of sheets of the copied paper are stored in the intermediate tray, the movable guide member is forcedly returned to the reference position, for example, home position. Thereby, an accumulative error of the movement of the movable guide member, which is accumulated during alignment operations of several times, can be corrected.

In another embodiment, a paper supplying base which includes an intermediate tray is supported to be movable as a whole in a direction orthogonally intersecting a paper feeding direction. Therefore, when a jam occurs in the intermediate tray and other relative portions, only by drawing out the paper supplying base in that direction, it is possible to easily remove a paper.

An image forming apparatus in accordance with another embodiment of the present invention comprises image forming means; paper supplying means for supplying a copying paper to the image forming means; discharge means for discharging a copied paper on which an image has been formed by the image forming means; an intermediate tray for temporarily storing the copied paper; and a direction changing portion for changing a feeding direction of the copied paper such that the copied paper can be fed to the discharge means or the intermediate tray, said direction changing portion being supported to be movable in a discharge direction.

In accordance with this embodiment, since the direction changing portion can be drawn out in the discharge direction of the copied paper, a paper jam which occurs in the direction changing portion can be easily dissolved.

The direction changing portion includes a guide plate which defines a path of the copied paper toward the discharge means and a path of the copied paper toward the intermediate tray, and the guide plate is pivotally supported at an end thereof in the discharge direction of the copied paper such that an opposite end of the guide plate can be opened. If the guide plate is opened, the copied paper being jamed in the paths can be easily removed.

In addition, preferably, the paper supplying means and the intermediate tray are supported to be movable in respective directions different from each other. Therefore, since the paper supplying means, the intermediate tray and the direction changing portion can be drawn out in different directions, even if a jam occurs in any portion, it is possible to easily remove a paper (copied paper or copying paper).

Furthermore, preferably, the paper supplying means is provided on the same paper supplying base for the intermediate tray, and a copying paper from the paper supplying means or a copied paper from the intermediate tray is fed to the image forming means through the same feeding roller. Then, the paper supplying means can be drawn out to a surface opposite to a feeding direction of the copying paper and the intermediate tray can be drawn out to a surface orthogonally intersecting a feeding direction of the copied paper.

An image forming apparatus in accordance with a still another embodiment of the present invention comprises image forming means; paper supplying means for supplying a copying paper to the image forming means; an intermediate tray for temporarily storing a copied paper on which an image has been formed by the image forming means; a feeding path for guiding the copied paper to the intermediate tray; feeding rollers provided in the feeding path at a predetermined interval in a direction of the feeding of the copied paper; and claws provided at downstream sides in a feeding direction of respective feeding rollers, said claws being selectively changed to a first position where the copied paper is allowed to be fed in the feeding path or a second position where the copied paper is directly sent into the intermediate tray. Preferably, the claws are provided at positions which correspond to different paper sizes.

In accordance with the embodiment, the copied paper which is fed in the feeding path is stored in the intermediate tray in an upside down state and the copied paper which is directly sent into the intermediate tray by the claws is stored in the intermediate tray in an upside up state. Then, if the claw is provided at each position corresponding to each of the paper sizes, a copied paper having an arbitrary paper size can be correctly positioned in the intermediate tray.

An image forming apparatus in accordance with the other embodiment of the present invention comprises an image forming means; a paper supplying means for supplying a copying paper to the image forming means; an intermediate tray for temporarily storing a copied paper on which an image has been formed by the image forming means; a feeding path for guiding the copied paper to the intermediate tray; and a pick-up roller provided in association with the intermediate tray and capable of selectively existing at a first position in the vicinity of an outlet of the feeding path or a second position where the pick-up roller is pressed against the copied paper on the intermediate tray, said pick-up roller being rotated in a direction where the copied paper enters in the intermediate tray when the pick-up roller exists at the first position or in a direction where the copied paper comes out from the intermediate tray when the pick-up roller exists at the second position.

In accordance with this embodiment, since the pick-up roller is rotated in a direction where the copied paper enters in the intermediate tray when the pick-up roller exists at the first position, the pick-up roller does not prevent the copied paper from entering in the intermediate tray. Therefore, it is not necessary to be large a distance between the first position and the second position of the pick-up roller, and therefore, it is possible to make the apparatus be compact.

The objects and other objects, features, aspects and advantages of the present invention will become more apparent from the following detailed description of the embodiments of the present invention when taken in conjunction with accompanying drawings.

DETAIL DESCRIPTION OF THE PREFERRED EMBODIMENTS

Figure 1:
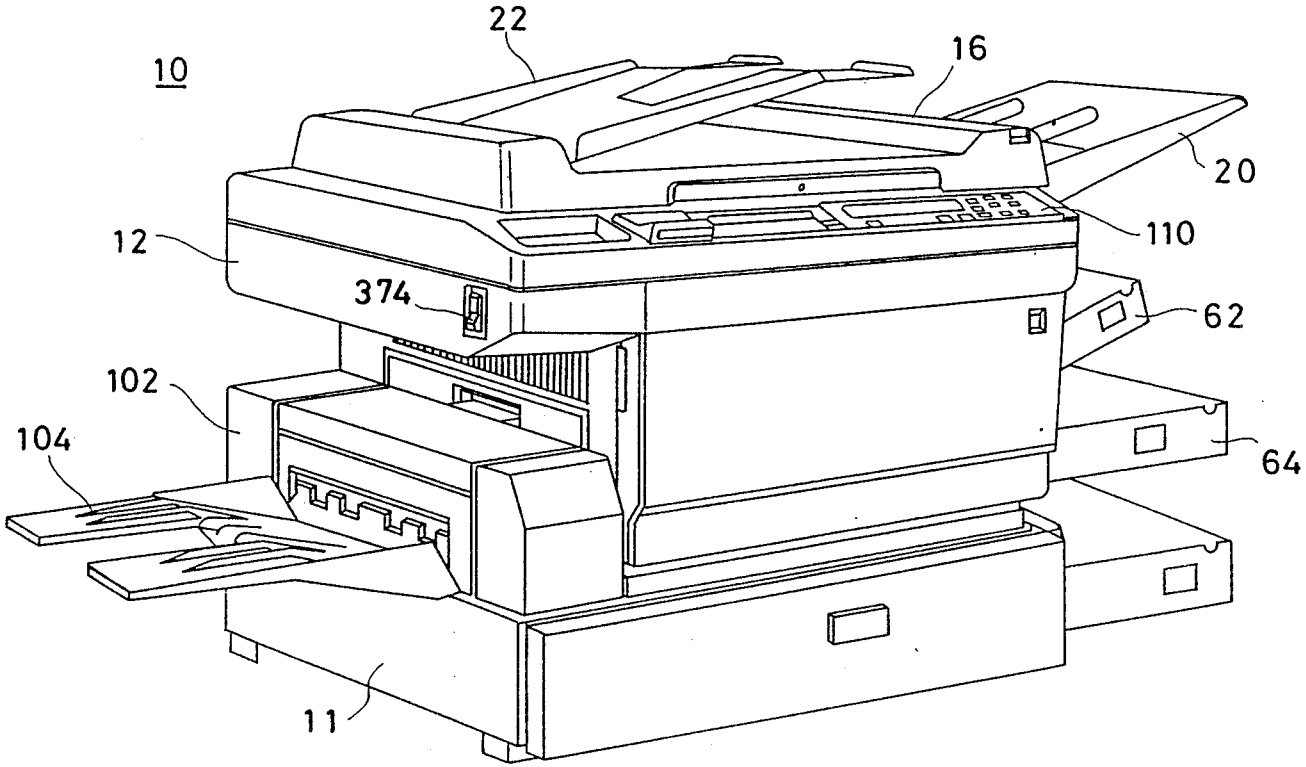
FIG. 1 is a perspective view showing an appearance of an electrophoto-graphic copying machine as one embodiment in accordance with the present invention.
Figure 2:
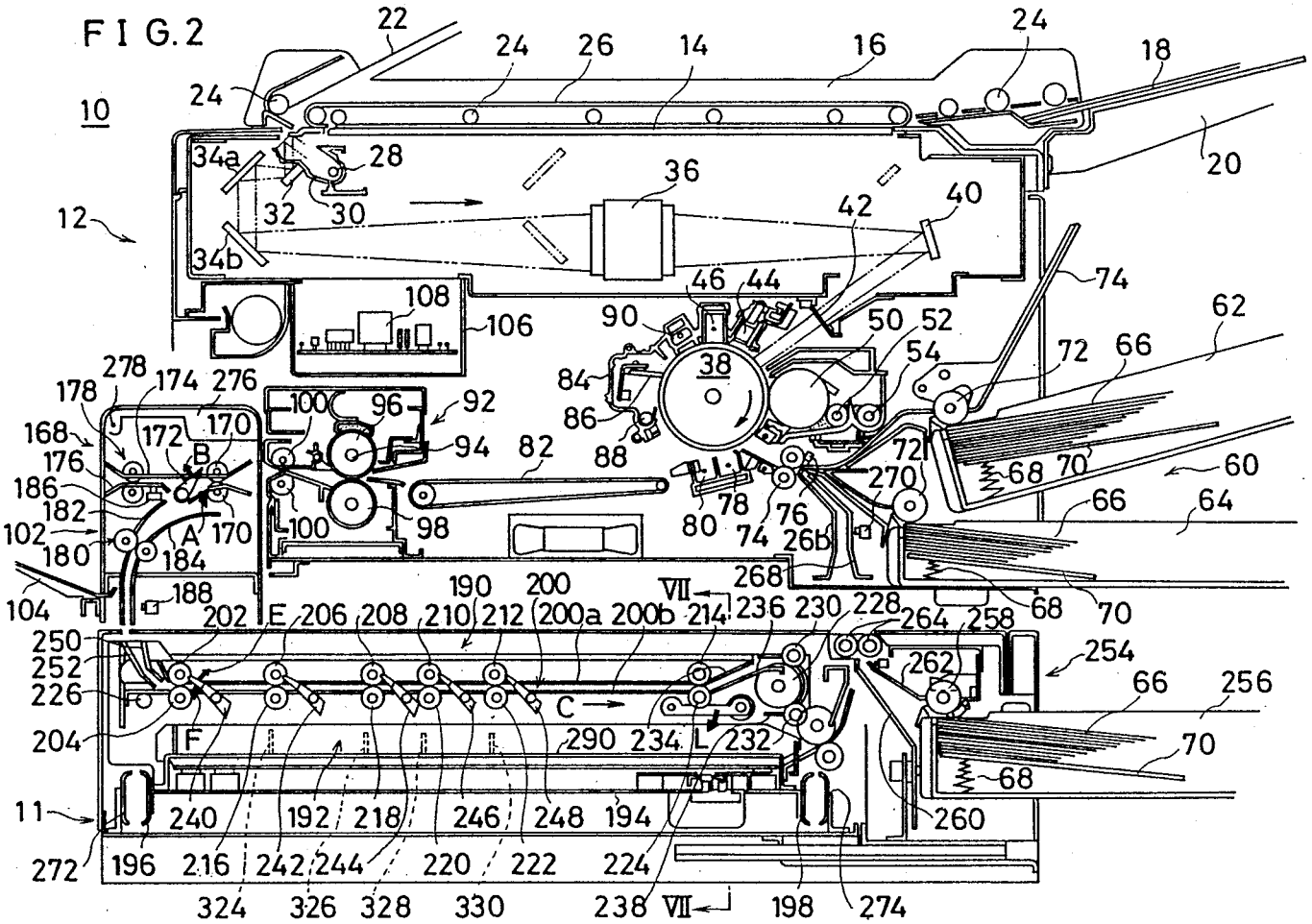
FIG. 2 is an illustrative cross-sectional view showing an internal structure thereof.

With reference to FIG. 1 and FIG. 2, an electrophotographic copying machine 10 includes a main unit 12 which is put on a paper supplying base 11. An original table 14 composed of a transparent glass plate is fixedly provided on a top of the main unit 12. Above the original table 14, an automatic document feeder 16 is mounted by a hinge at the side end thereof. The automatic document feeder 16 includes a plurality of rollers 24 and an endless belt 26 such that an original 18 put on an original feeding table 20 can be taken in and transferred toward the original table. The original which has been copied through the automatic document feeder 16 is transferred to an original receiving table 22.

Below the original table 14, a light source 28 as an optical scanning means for exposing and scanning the original is provided in the main unit 12. The light source 28 is made movable from one end of the original table 14 to the other end thereof and vice verse. A movement of the light source 28 toward left and right is performed by a driving force of a servo motor (not shown). In association with the light source 28, a reflecting mirror 30 having an elliptic cross-section is provided. A first movable mirror 32 is fixed to the reflecting mirror 30. When the light source 28 is moved toward right in FIG. 2 by the servo motor, the original 18 put on the original table 14 is subjected to a slit-exposure. However, when the light source 28 is moved toward left in FIG. 2, no exposure is made.

In association with the first movable mirror 32, a pair of second movable mirrors **34*a* and 34*b* are provided. The pair of second movable mirrors 34*a* and 34*b* are for reflecting again the original image reflected by the first movable mirror 32 toward a focusing lens 36. The second movable mirrors 34*a* and 34*b* are moved in the same direction as the light source 28 at a half speed thereof. In addition, the focusing lens 36** is, in the embodiment, constructed by a zoom lens, and therefore, a copy magnification can be changed.

In front of the zoom lens 36, a fixed reflecting mirror 40 is provided so as to reflect the original image through the lens 36 toward a photosensitive drum 38. An infrared light absorbing filter 42 is interposed between the fixed reflecting mirror 40 and the photosensitive drum 38.

At the downstream side from an exposed position of the photosensitive drum 38, that is, the position where the original image is focused by the fixed reflecting mirror 40, a partial erasure lamp, that is, an LED array 44 which partially erases a useless electrostatic latent image is provided. At the upstream side from the partial erasure lamp 44, a charging corotron 48 for uniformly charging the photosensitive drum 38 in a predetermined polarity is provided.

At the downstream side from the exposure position of the photosensitive drum 38, a developing device 50 is provided, which toner-develops the electrostatic latent image formed on the photosensitive drum 38 by the charging corotron 46, light source 28 and the zoom lens 36. In association with the developing device 50 there are provided an agitator roller 52 for agitating a toner and a supplying roller 54 for supplying a charged toner to the photosensitive drum 38.

At one side of the main unit, a paper supplying portion 60 is formed. In the paper supplying portion 60, two paper supplying cassettes 62 and 64 are attached in an attachable or detachable manner. Copying papers having different sizes are respectively accommodated in a stack fashion in the paper supplying cassettes 62 and 64. At the bottom of the paper supplying cassettes 62 and 64, a coil spring 68 for pushing stacked papers 66 up and supporting plates 70 are provided, respectively. The copying papers 66 accommodated in the paper supplying cassettes 62 and 64 are pushed up by the coil springs 68 and the supporting plates 70, and the upper most one is brought in contact with paper supplying rollers 72 to be picked-up. One of the paper supplying rollers 72 sends the copying paper 66 being pressure-contacted from the paper supplying cassette 62 or 64 to a register roller 74 one by one by a rotation thereof In addition, a manually paper supplying plate 75 is provided in association with the upper one of the paper supplying rollers.

A paper sensor 76 for detecting that the copying paper 66 has been sent at a position thereof is provided in the vicinity of the register roller 74.

At the downstream side from the developing device 50, that is, register roller 74, a transferring corotron 78 and a separating corotron 80 are installed in a one-piece fashion.

When the copying paper 66 is supplied from the paper supplying cassettes 62 or 64, a toner image formed on the photosensitive drum 38 is transferred onto the copying paper 66 by the transferring corotron 78. In transferring by means of the transferring corotron 78, the copying paper 66 is absorbed by the photosensitive drum 38 and intends to move together with the same, but the copying paper 66 is separated by the separating corotron 80, being fed toward a vacuum conveyer 82.

A cleaning device 84 is provided at the downstream side from the separating corotron 80 and in the vicinity of the peripheral side surface of the photosensitive drum 38. The cleaning device 84 removes a toner left on the photosensitive drum 38 after transferring the toner image onto the copying paper 66. The cleaning device 84 includes a rubber blade 86 for scrapping the remaining toner off from the photosensitive drum 38. The toner scrapped off by the blade 86 is conveyed to a waste toner container (not shown) by a screw conveyer 88.

At a further downstream side from the cleaning device 84, an erasure lamp 90 for removing a charge remaining on the photosensitive drum 38 is provided. At the downstream side from the erasure lamp 90, the above described charging corotron 46 is arranged.

The copying paper 66 which is separated by the separating corotron 80 is sent to a fixing device 92 by the vacuum conveyer 82. The fixing device 92 is provided with a heating roller 96 which incorporates a heater 94 and a pressure roller 98 for pressure-contacting the paper with the heating roller 96. Therefore, the copy image which has been transferred onto the copying paper 66 is heated and pressed to be fixed on the copying paper 66. The copying paper 66 after fixing, that is, a copied paper **66*a* is sent in a direction changing portion 102 through a pair of paper discharging rollers 100. The copied paper 66*a* being sent to the direction changing portion 102 is discharged onto a paper discharging tray 104 as it is or to the aforementioned paper supplying base 11** described later in detail.

Figure 13:
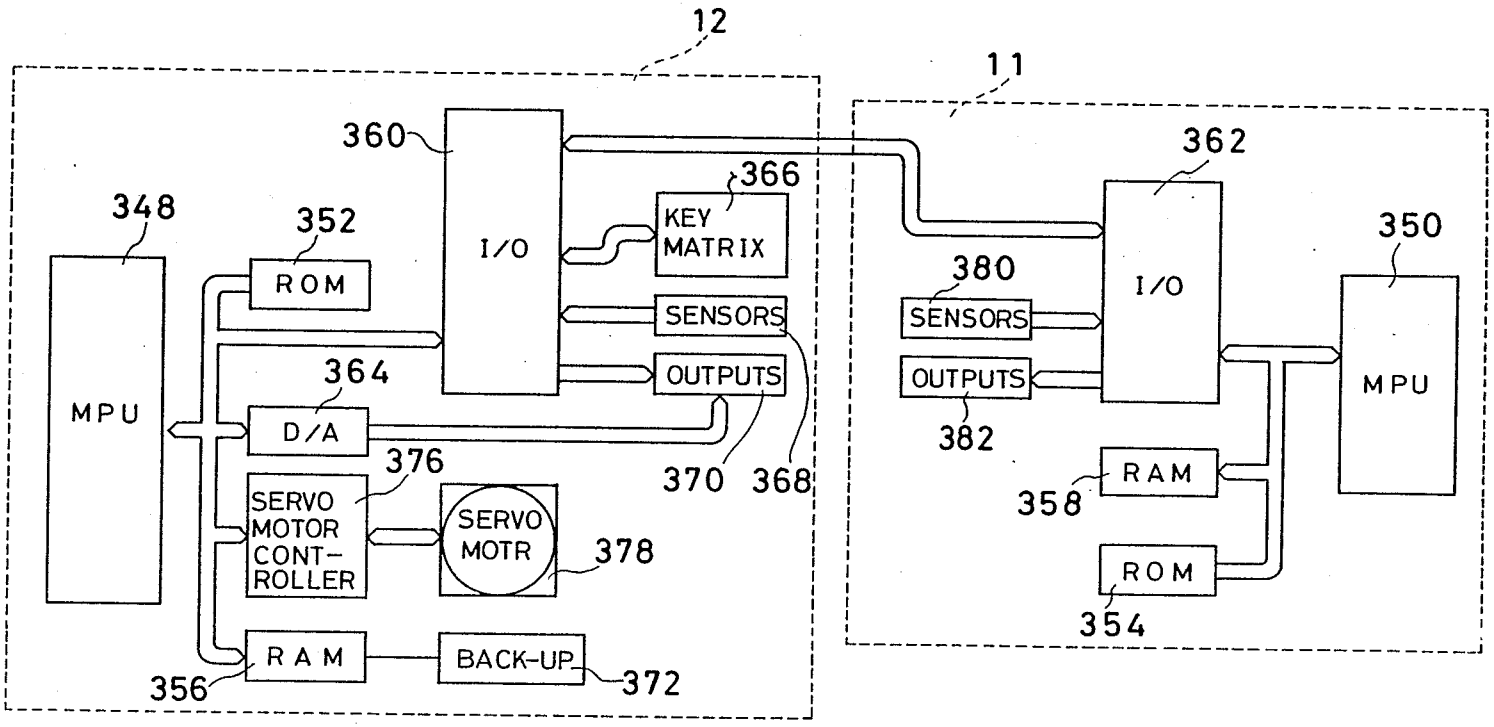
FIG. 13 is a block diagram showing a control system of the embodiment.

Furthermore, a control box 106 is formed above the fixing device 92 in the main unit 12. In the control box 106, circuit components 108 for a control system which is described later and shown in FIG. 13 are accommodated.

Figure 3:
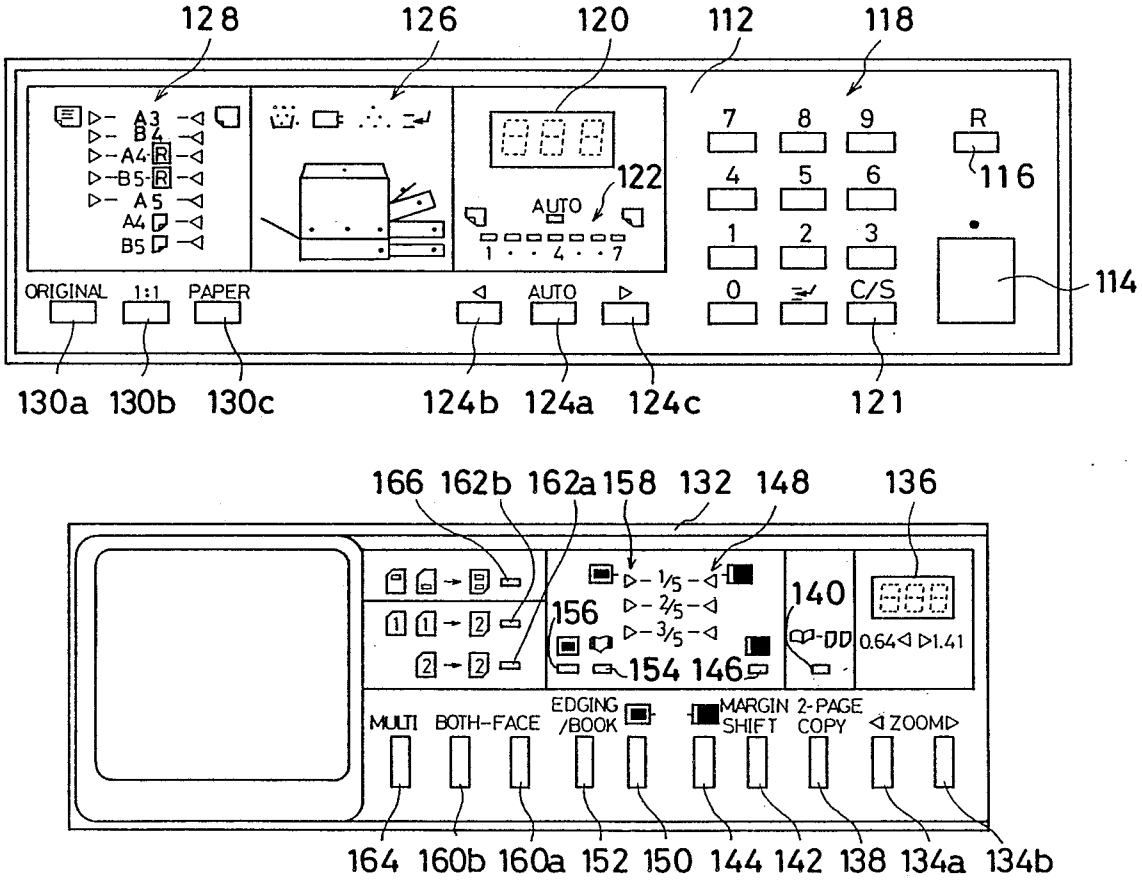
FIG. 3 is an illustrative view showing an operation panel.

An operation panel 110 is provided on an upper surface of this side of the electrophotographic copying machine main unit 12. With reference to FIG. 1 and FIG. 3, a start key 114 for commanding a start of a copying process is provided at a right end of a right panel 112 of the operation panel 110. A reset key 116 for releasing a mode being set by an operation of keys in the operation panel 110 is provided above the start key 114. A ten-key 118 for setting a copy quantity or for releasing such setting and for processing an insertion copy is provided at a left side of the start key 114. A copy quantity set by the ten-key 118 is displayed on a copy quantity display 120 which is provided at a left side of the ten-key 118. The copy quantity display 120 is a 3-digit display each digit thereof is composed of 7 segments.

In addition, in the vicinity of the ten-key 118, there is provided a clear/stop key 121 which is operated for releasing a numeral value being set by the ten-key 118 or for commanding a stop of the copying process.

A density indicator 122 for indicating a density of a copy image is provided below the copy quantity display 120. Keys **124*a*–124*c* for setting a density of a copy image are provided below the density indicator 122. When a copy density is to be set automatically, the key 24*a* is operated. Then, "AUTO" of the density indictor 122 is lightened. When the copy density is set to be manually, the keys 124*c* or 124*b* is operated. A set density is indicated by the density indicator 122** in seven notches.

A status indicator 126 for indicating occurrence of a jam, lack of toner, lack of paper or the like is provided at a left side of the copy quantity display 120 and the density indicator 122. A size indicator 128 for indicating sizes of an original and a paper is provided at a left side of the status indicator 126, that is, at a let end of the right panel 112. Keys **130*a*–130*c* for setting sizes of the original and the paper are provided blow the size indicator 128. In addition, the decision which one of the two paper supplying cassettes 62 and 64 attached as shown in FIG. 1 should be used is made by operating a paper size setting key 130*c*. When a paper sizes set by the paper size setting key 130*c*, only one LED of seven LEDs respectively corresponding to respective paper sizes is lightened. When an original sizes set by an original size setting key 130*a*, only one LED of five LEDs arranged at a left side of the size indicator 128 is lightened. If the original size and the paper size are thus set by the original size setting key 130*a* and the paper size setting key 130*c*, a magnification of an enlargement or a reduction of a copy is automatically decided. A decided magnification is displayed on a display described later. An equal magnification key 130*b*** is a key which is operated when an equal magnification copy should be made irrespective of the original size and the paper size.

Magnification setting keys **134*a* and 134*b* for setting a copy magnification of an enlargement or a reduction of a copy are provided at a right lower portion of a left panel 132. A magnification set by these magnification setting keys 134*a* and 134*b* is displayed on a magnification display 136 which is provided above the keys. In addition, the magnification setting keys 134*a* and 134*b* are effectively operated only when the original size setting key 130*a* and the equal magnification key 130*b* were not operated. More specifically, when the copy magnification is set by operating the original size setting key 130*a* and the paper size setting key 130*c*, the copy magnification which was automatically decided is displayed on the magnification display 136**.

A 2-page copy key 138 is provided at a left side of the magnification setting key **134*b*. When a left side and a right side of an opened book should be separately copied onto two sheets of paper, the 2-page copy key 138 is used. When the 2-page copy key 138 is operated, an LED 140 provided just thereabove is lightened. A margin shift key 142 for shifting an original image rightward and for copying so as to form a space for binding at a left side end of the paper is provided at a left side of the 2-page copy key 138. A margin setting key 144 for setting a margin width is provided at a left side of the margin shift key 142. When the margin shift key 142 is operated, an LED 146 is lightened and the margin setting key 144 becomes in a state where the same can be effectively operated. A margin width can be set by the margin setting key 144 is in three notches and, a set margin width is indicated by lightening any one of three LEDs 148**.

An edging width setting key 150 and an edging/book selecting key 152 are provided at a left side of the margin setting key 144. When an edging mode is set by the edging/book selecting key 152, and LED 154 is lightened and, when a book mode is set, an LED 156 is lightened. The edging width setting key 150 can be effectively operated only when the edging mode is selected by the edging/book selecting key 152. The edging width setting key 150 is a key for preventing a line of the edge of the original from being copied, and an edging width can be selected by the key 150 in three notches. An edging width being set is indicated by lightening only one of three LEDs 158.

Double-face copy keys **160*a* and 160*b* which are operated when a double-face copy is to be performed are provided at a left side of the edging/book selecting key 152. The double-face copy key 160*a* is operated in the case where the original on both surfaces of which images are respectively formed is to be copied on both surfaces of a copying paper and the double-face copy key 160*b* is operated in the case where two originals on each one surface of which an image is formed are to be copied on both surfaces of a copying paper. In response to an operation of the double-face copy key 160*a*** or 160*b*, an LED 162*a* or 162*b* is lightened. In addition, a multi-copy key 164 is operated when an image is to be copied on the same surface of a single copying paper in a superposed manner, and in response to an operation of the same, an LED 166 is lightened.

Next, with reference to FIG. 2, FIG. 4 and FIG. 5, the paper supplying base 11, that is, a mechanism for resupplying a paper will be described. The paper supplying base 11 includes a direction changing portion 168 in which a roller pair 170 is arranged at a left side upper surface to be faced to the roller pair 100 of the aforementioned fixing device 92 within the copying machine main unit 12. In the direction changing portion 168, a copied paper which was discharged by the roller pair 100 of the main unit 12 is entered to an inside thereof by the roller pair 170. A claw 172 is provided at a just downstream side of the roller pair 170, and the claw 172 is driven by a solenoid (not shown) to be changed in a direction of an arrow mark A or in a direction of an arrow mark B in FIG. 2. When the claw 172 is changed to the arrow mark direction A, the copied paper is discharged from a paper discharging roller pair 178 to the paper discharging tray 104 after passing between paper guides 174 and 176. On the other hand, when a copy image is to be formed on both surfaces of a copying paper (a double-face copy) or a copy image is to be repeatedly formed on the same surface of a copied paper (a multi-copy), the claw 172 is changed in the arrow mark direction B by the solenoid. At this time, the copied paper is fed between paper guides 182 and 184 by a feeding roller pair 180, being sent from the bottom portion of a direction changing portion 168 to the paper supplying base 11 .

In addition, paper sensors 186 and 188 for detecting that a copied paper is sent to positions thereof are respectively provided in the vicinity of the above described paper guides 176 and 184.

In the paper supplying base 11, a reversal portion 190 having an intermediate tray 192 is formed. As well seen from FIG. 4 and FIG. 5, the reversal portion 190 is provided on a base 194 which is supported by slidable members 196 and 198 such that both sides in a direction of a length thereof can be slidden in a direction of a width thereof. Therefore, it is possible to draw the base 194 out to this end of the main unit 12, and therefore, it is possible to easily remove a paper (copied paper or copying paper) which occurs a jam in the paper supplying base 11. Then, the above described intermediate tray 192 is further fixed on the base 194, and a feeding path 200 is formed above the intermediate tray 192. As well seen from FIG. 4 especially, the feeding path 200 is defined by an upper guide 200*a* having a feeding roller 202 and a lower guide 200*b* having a feeding roller 204.

As shown in FIG. 2, the upper guide 200*a* includes feeding rollers 206, 208, 210 and 212 rotation shafts of which are arranged within the same plain and in parallel with a rotation shaft of the feeding roller 202. The feeding rollers 206–212 are separated from each other in a direction of a length of the reversal portion 190 so as to correspond paper sizes. Then, a feeding roller 214 is provided in the vicinity of a right end portion of the upper guide 200*a*.

The lower guide 200*b* includes a plurality of feeding rollers 204, 216, 218, 220, 222 and 224 each of which is faced and contacted to each of the rollers 202, 206, 208, 210, 212 and 214 provided in the upper guide 200*a* so as to constitute feeding roller pairs, respectively. More specifically, the feeding path 200 of a copied paper is formed by respective roller pairs 202 and 204, 206 and 216, 208 and 218, 210 and 220, 212 and 222, and 214 and 224. The copied paper which was discharged from the fixing device 92 of the main unit 12 through the direction changing portion 168 is fed in a direction of an arrow mark C in a state where the copied paper is turned over, that is, a surface on which a toner image has been fixed is faced downward when the copied paper is passed through the paper feeding path 200.

Figure 4:
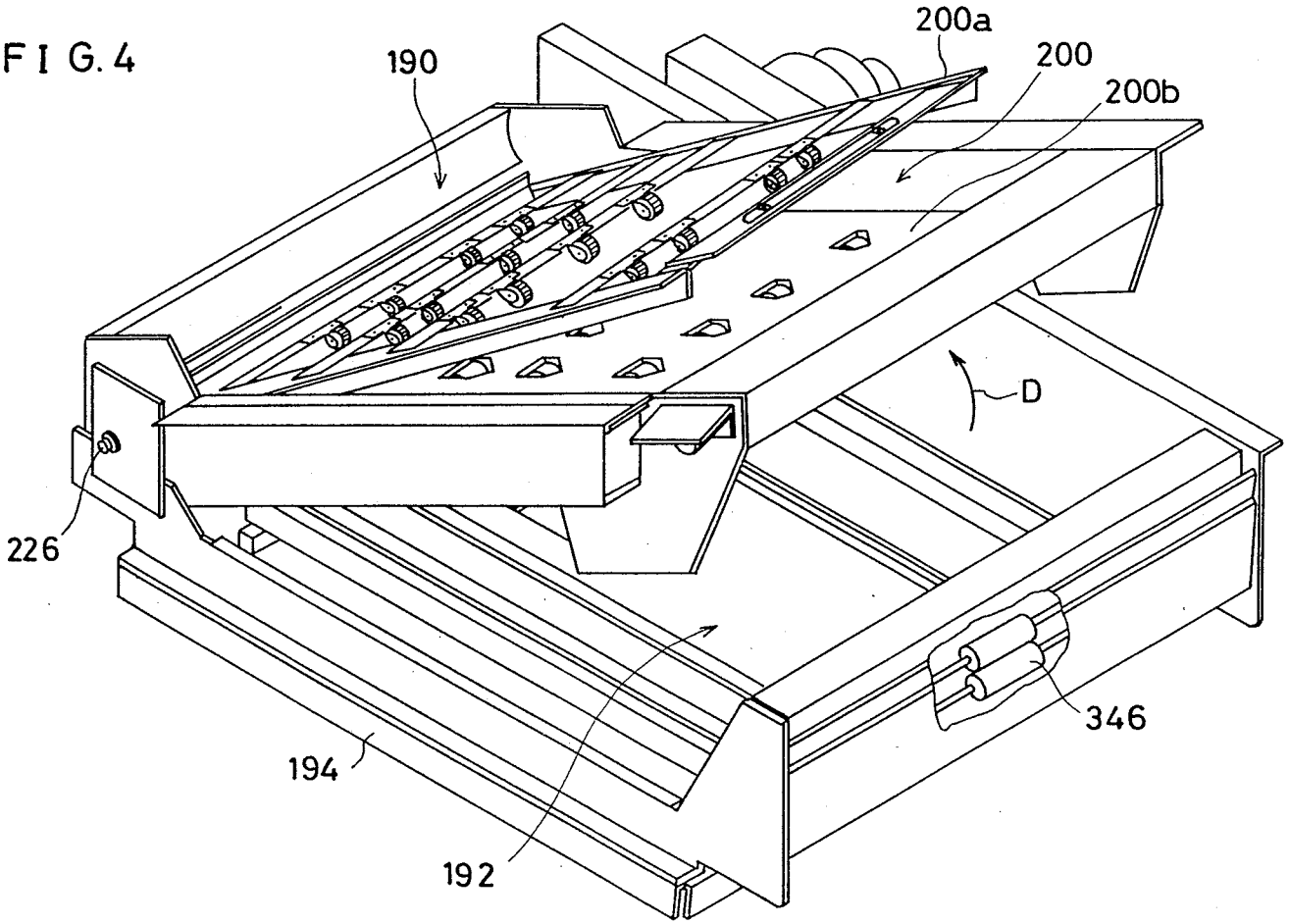
FIG. 4 is a perspective view showing a major portion of a paper supplying base.

As shown in FIG. 4, the upper and lower guides 200*a* and 200*b* are supported to be opened in a direction toward the above portions of the intermediate tray 192, that is, a direction of an arrow mark D by a shaft 226 which penetrates the guides 200*a* and 200*b* at the vicinity of left ends thereof in a direction of a depth thereof (a width direction) and is also used as a driving shaft of respective rollers 204, and 216–224 of the lower guide 200*b*. Similarly, the respective guides 200*a* and 200*b* are constructed to be opened from each other, whereby it becomes easy to process a jam therebetween, as described later.

Reversal rollers 228, 230 and 232, and guides 234, 236 and 238 for the reversal rollers are provided at a right side portion of the upper and lower guides 200*a* bad 200*b*. The reversal rollers 228, 230 and 232, and the guides 234, 236 and 238 send the copied paper which is fed from the feeding roller pairs 214 and 224 into the intermediate tray 192 which exists below the lower guide 200*b* in a state where the copied paper is turned over again, that is, a surface on which a toner image has been fixed is faced upward.

In addition, claws 240, 242, 244, 246 and 248 are provided at a downstream side in a direction for feeding a copied paper by the feeding rollers 204, 216, 218, 220, 222 and 224 of the lower guide 200*b*. In the case of the multi-copy, that is, in the case where an image is to be copied on the same surface of the same copied paper, by changing any one of the claws to a direction of an arrow mark E and by changing the claw which exists at an upstream side of that claw in a feeding direction to a direction of an arrow mark F, a copied paper having a size that corresponds to a position of the claw which are changed to the arrow mark direction E can be sent in the intermediate tray 192 in a state where the surface on which the toner has been fixed is faced downward. For example, in the case where the claw 240 is changed to the arrow mark direction E, a tip end of the copied paper which is sent through a gap between guides 250 and 252 is guided to a downward direction by the claw 240, and therefore, the copied paper is fallen in the intermediate tray 192 from a position of the claw 240. Thus, the claw 240 guides a copied paper having a paper size of A3 into the intermediate tray 192 when the multi-copy is to be processed. Similarly, when the multi-copy is to be processed, the claws 242, 244, 246, and 248 respectively guide a copied paper having a paper size of B4, a copied paper having a paper size of A4R, a copied paper having a paper size of B5R, and a copied paper having a paper size of A4 or B5. Since a copied paper is guided into the intermediate tray 192 at the best position for a paper size of the copied paper by the claws 240–248, the tip end position of the copied paper which is stored in the intermediate tray 192 can be always aligned at a predetermined position irrespective of the paper size.

In addition, in the case where the double-face copy is to be processed, all of the claws 240–248 are changed to the arrow mark direction F, whereby the aforementioned feeding path 200 is opened such that the copied paper can be fed in the feeding path 200.

Furthermore, an additional cassette insertion portion 254 to which a third paper supplying cassette 256 is inserted in an attachable or detachable manner is arranged at a right side portion of the intermediate tray 192. As similar to the above described cassettes 62 and 64, the additional cassettes 256 stores a copying paper 66 on the supporting plate 70 provided in the additional cassette. A copying paper which is pushed up by a coil spring 68 is sent by a paper feeding roller 258 and thereafter the copying paper is pushed upward by a roller pair 264 through a gap between guides 260 and 262. The copying paper 66 is further sent to the register roller 74 through a path which is defined by guides 266 and 268. In addition, a paper sensor 270 for detecting whether or not a copying paper has been sent to the position thereof is provided in the vicinity of the guide 268.

Figure 5:
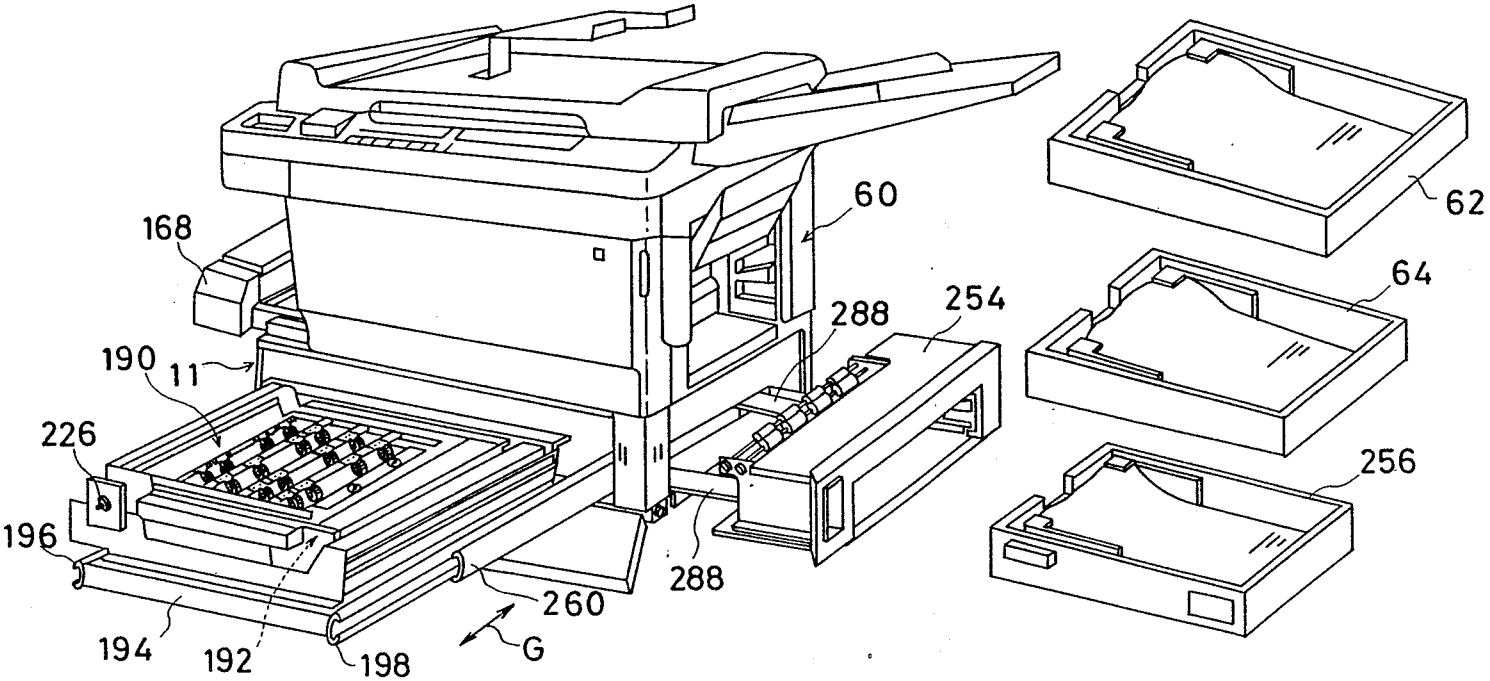
FIG. 5 is a perspective view showing a state where an intermediate tray, an additional cassette insertion portion, and so on are opened in the embodiment.
Figure 6:
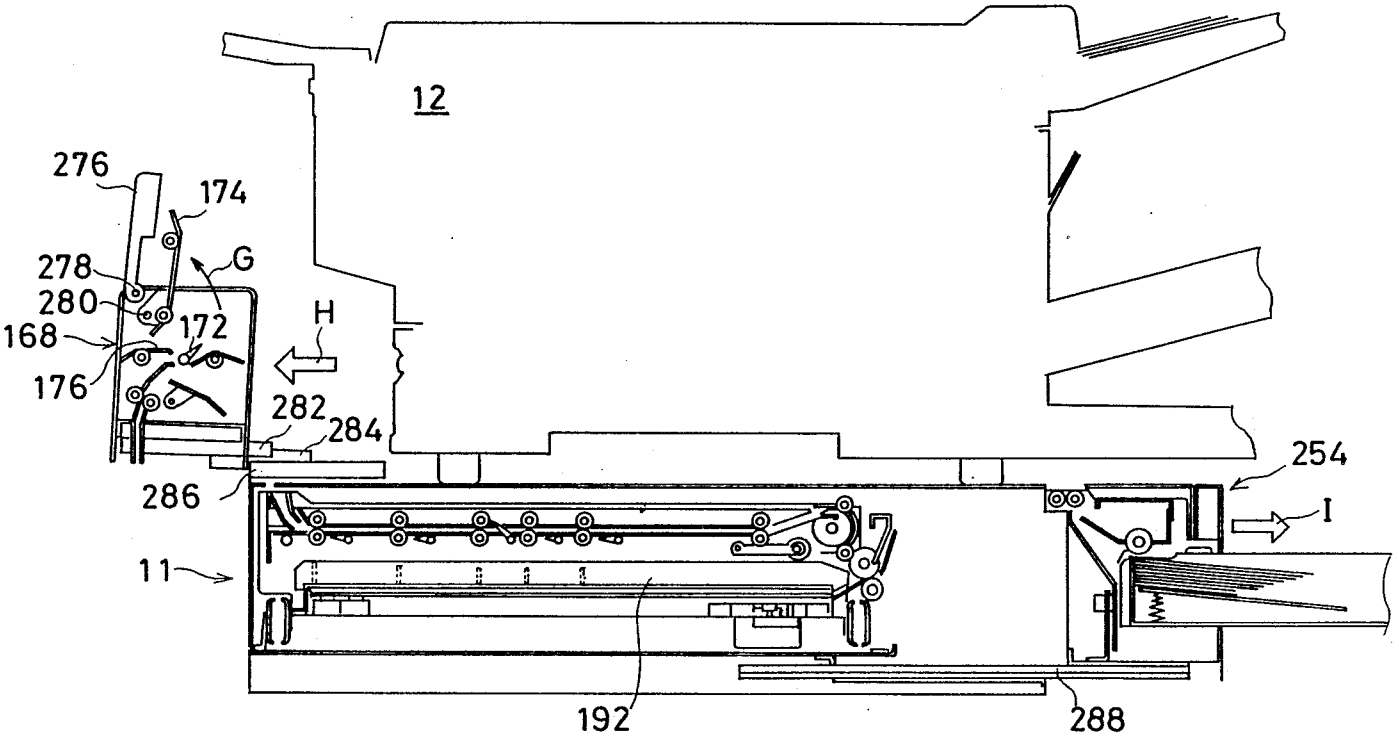
FIG. 6 is an illustrative view showing a state where a direction changing portion and an additional cassette insertion portion are drawn out in different directions, respectively.

As well seen from FIG. 5 and FIG. 6, the aforementioned direction changing portion 168, reversal portion 190 and additional cassette insertion portion 254 can be opened to be projected leftward, forward and rightward of the paper supplying base 11, respectively, whereby it becomes possible to process a jam easily.

More specifically, as described above, the reversal portion 190 which includes the intermediate tray 192 is supported on the base 194 which is supported by the slidable members 196 and 198, and 272 and 274, that is, two pairs of arcuate rails in a manner that the base 194 can be slidden in a direction of an arrow mark G in FIG. 5. In the case where a jam occurs in the reverse portion 190 or intermediate tray 192, when the base 194 is drawn out to this side, the reversal portion 190 or intermediate tray 192 is exposed outside the paper supplying base 11, as shown in FIG. 5. Then, as shown in FIG. 4, if the gap between the upper and lower guides **200*a* and 200*b*, that is, the feeding path 200 is opened, a copied paper (not shown) which is stopped in the path 200 can be easily removed. Similarly, since the gap between the lower guide 200*b* and the intermediate tray 192 can be opened, a copied paper is also removed easily even if a jam occurs in the intermediate tray 192**.

Furthermore, as well seen from FIG. 2 and FIG. 6, the direction changing portion 168 includes a cover 276 which is supported by a shaft 278 in a manner that the cover 276 can be rotated in a direction of the arrow mark G in FIG. 6 while the shaft 278 functions as a supporting point. In addition, the aforementioned guide 274 is supported by a shaft 280 in a manner that the guide 274 can be rotated in the same arrow mark direction G since the shaft 280 functions as a supporting point. Then, the direction changing portion 168 is supported as a whole by a rail 282. The rail 282 engages with a rail 284 which is fixed on a supporting plate 286, and therefore, by cooperation of the rails 282 and 284, the direction changing portion 168 can be drawn out as a whole in a direction of an arrow mark H in FIG. 6. If a jam occurs in the direction changing portion 168, the direction changing portion 168 is first drawn out in the arrow mark direction H and then, the guide 174 and the cover 276 are pulled up in the arrow mark direction G. Therefore, a path defined by the guides 174 and 176 is opened so that it is possible to easily remove a copied paper which occurs a jam.

In addition, the additional cassette insertion portion 254 is supported by a rail 288 as shown in FIG. 5 and FIG. 6 in a manner that the additional cassette insertion portion 254 can be drawn out in a direction of an arrow mark I in FIG. 6. When the additional cassette insertion portion 254 is drawn out in the arrow mark direction I, as shown in FIG. 5 and FIG. 6, a relatively large space can be formed between the intermediate tray 192 and the additional cassette 256. Since such a space can receive a hand of a human being, it is also possible to easily dissolve a jam which occurs in the additional cassette insertion portion 254.

Figure 7:
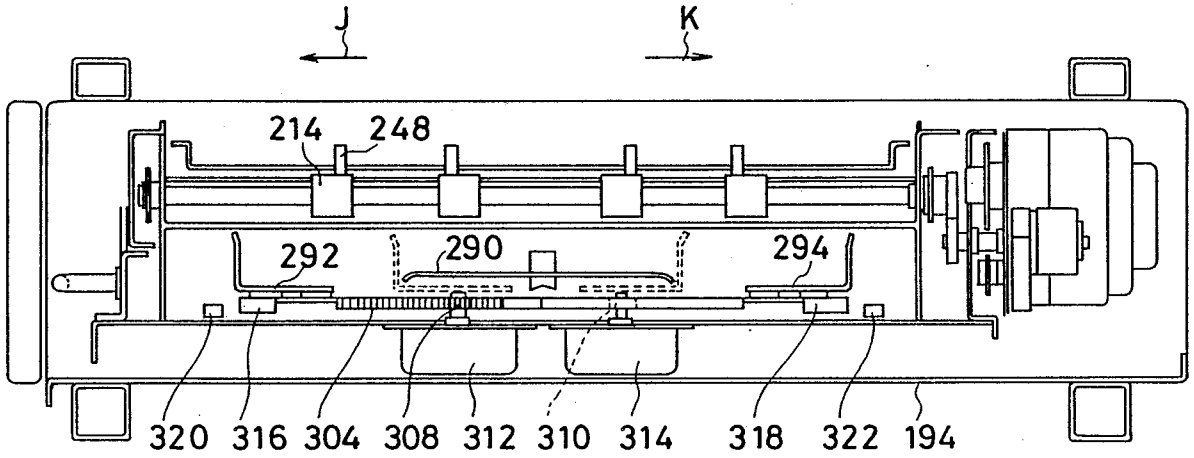
FIG. 7 is an illustrative view viewing at a line VII—VII in FIG. 2.

Next, with reference to FIG. 7–FIG. 9, a configuration of the intermediate tray 192 will be described. The intermediate tray 192 includes a tray bottom plate 290 which is positioned at a center of the base 194 in a direction of a length thereof and extends along a direction of a width, and a surface of the tray bottom plate 290 which is in parallel with an upper surface of the base 194 is positioned at a position higher than the upper surface of the base 194. The intermediate tray 192 also includes a pair of movable guide members 292 and 294 having L-letter shaped in cross-section which are extended in parallel with the tray bottom plate 290 and supported to be movable in a direction orthogonally intersecting respective longitudinal directions, that is, in a direction of an arrow mark J or K in FIG. 7 and FIG. 8. More specifically, the movable member 292 is supported by two pairs of arcuate rails 296 and 298 to be movable in the arrow mark direction J or K. Similarly, the movable guide member 294 is supported by two pairs of arcuate rails 300 and 302 to be movable in the arrow mark direction J or K. In other words, a center portion of a copied paper is put on the tray bottom plate 290 and both side edge portions of the copied paper projecting from the tray bottom plate 290 are put on the movable guide members 292 and 294. Then, by a reciprocated action of the movable guide members 292 and 294, both side ends of the copied paper can be aligned.

A rack 304 (or 306) is fixed to the movable guide member 292 (or 294) such that a longitudinal direction thereof can be coincident with a direction orthogonally intersecting the longitudinal direction. When a pinion 308 (or 310) which bites rack teeth of the rack 304 (or 306) is driven for rotation by a stepping motor 312 (or 314) which is provided below the base 194, the movable guide member 292 (or 294) is moved in a direction that the movable guide member is closed to or apart from both side ends of the tray bottom plate 290. Then, there is a light shutting plate 316 (or 318) below the movable guide member 292 (or 294), and when the light shutting plate 316 (or 318) is detected by a home position sensor 320 (or 322) when the movable guide member 292 (or 294) is moved to a position where the movable guide member is extremely apart from the tray bottom plate 290, that is, a position forming a width wider than a width of a paper having a maximum paper size. Therefore, it is detected by the home position sensor 320 (or 322) that the movable guide member 292 (or 294) is in the home position. An action of the guide members 292 and 294 for alignment of the side ends of the copied papers stored in the intermediate tray 192, that is, a reciprocated action of the movable guide members 292 and 294 will be described later in detail with reference to a flowchart.

Figure 10:
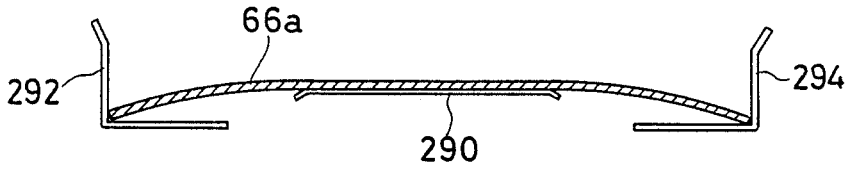
FIG. 10 is an illustrative cross-sectional view showing a state where a copied paper is stored in an intermediate tray.

Since the tray bottom plate 290 is positioned at the position higher than that of the movable guide members 292 and 294 which are arranged at both side thereof, a center portion of a copied paper **66*a* which is sent into the intermediate tray 192 is pushed upward, and therefore, as shown in FIG. 10, the copied paper 66*a* is curved in an arc fashion as a whole. Therefore, a friction which occurs between the copied paper 66a and the intermediate tray 192 becomes small such that the copied paper 66a enters straight in the intermediate tray 192, whereby an ability that the copied paper 66a** goes straight on can be increased.

Figure 8:
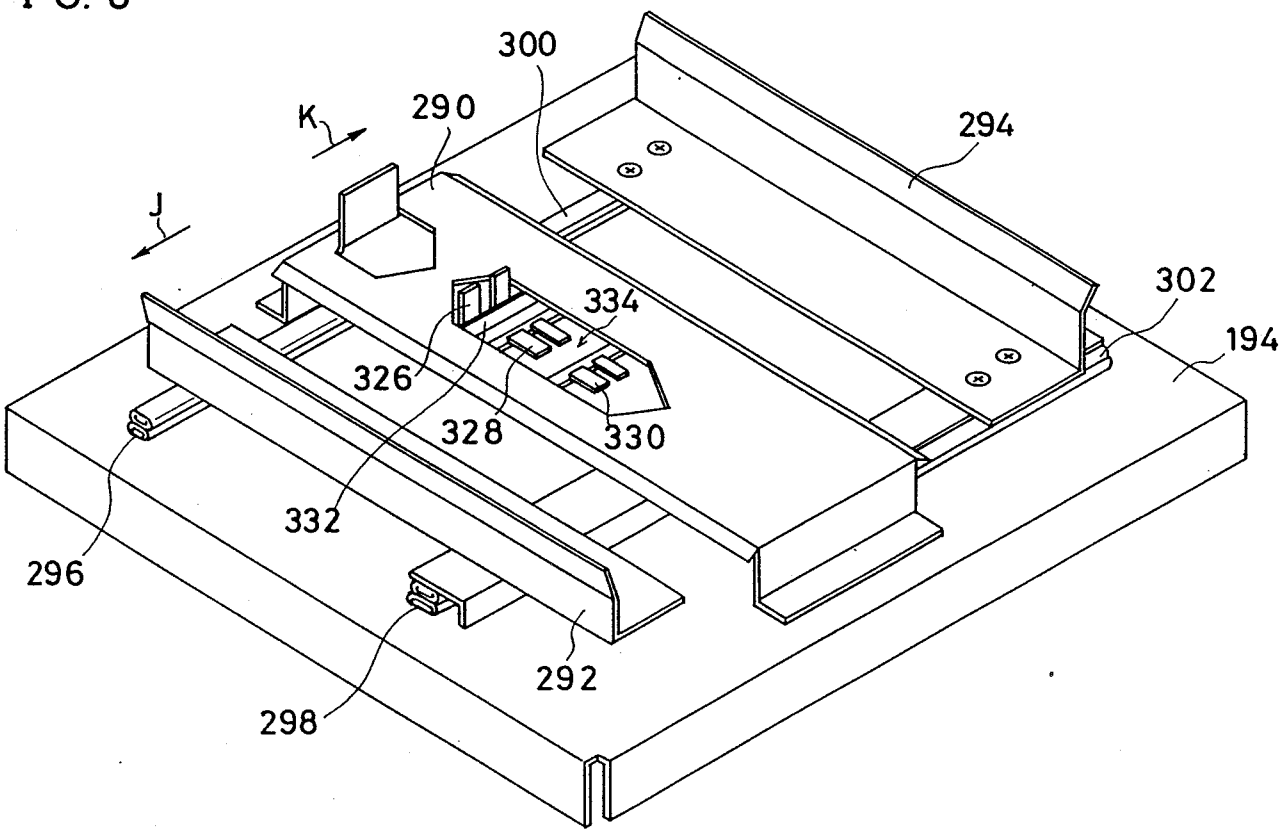
FIG. 8 is a perspective view showing an intermediate tray.
Figure 9:
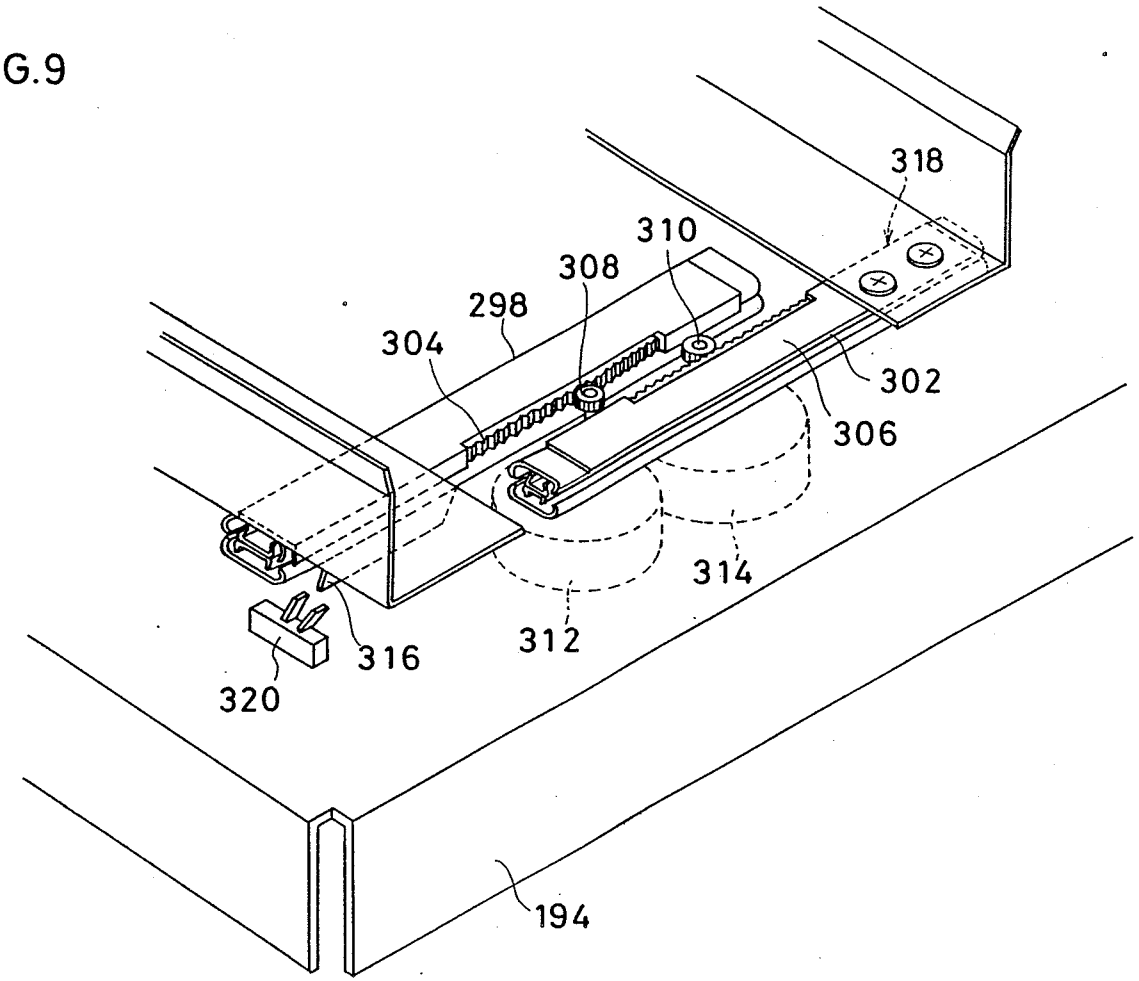
FIG. 9 is an enlarged perspective view showing a major portion of FIG. 8.

As shown in FIG. 2 and FIG. 8, stoppers 324–330 which stand up and project above the tray bottom plate 290 are provided as necessary. The stoppers 324–330 align a tip end portion of the copied paper which is sent into the intermediate tray 192 from the above described reversal rollers 228–232 when the double-face copy is to be processed, and the stoppers 324–330 are supported by a plate 332 at a position corresponding to each paper size. The plate 332 is rotated by a solenoid (not shown). For example, when a copied paper having a paper size of B4 is to be sent to the intermediate tray 192 through the reversal rollers 228–232, the plate 332 which supports the stopper 326 is rotated by the solenoid, whereby the stopper 326 is projected above the tray bottom plate 290 through an opening 334 of the tray bottom plate 290 as shown in FIG. 8. Therefore, the copied paper passing the reversal roller 232 is slidden on the tray bottom plate 290 and sent into the intermediate tray 192. At this time, the tip end of the copied paper is stopped by the stopper 324 which stood up. In addition, the remaining stoppers 324, 328, and 330 function in the same manner. As similar to the aforementioned multi-copy, in processing the double-face copy, the tip end portion of the copied paper is positioned at a predetermined position in the intermediate tray 192 by any one of the stoppers 324–330.

Figure 11:
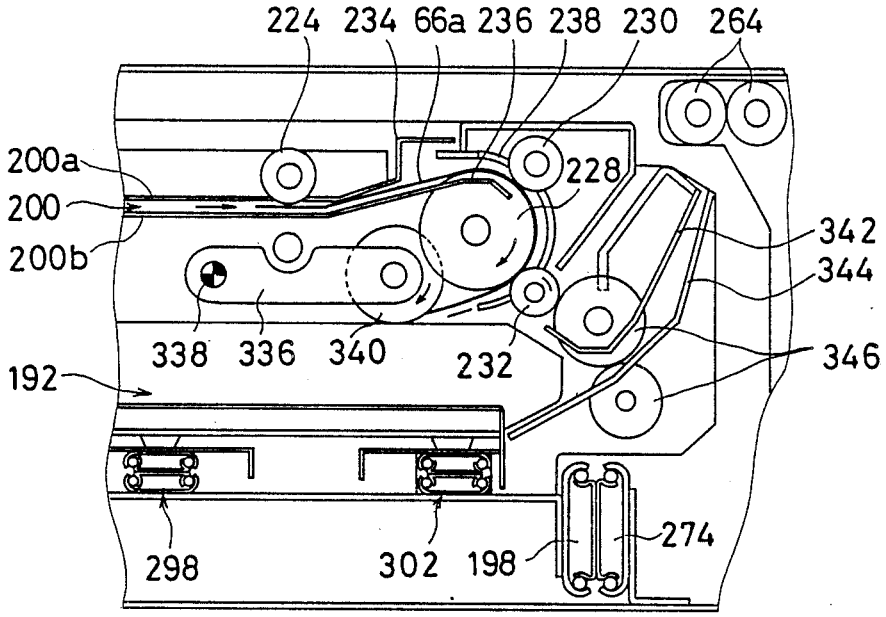
FIG. 11 and FIG. 12 are illustrative views respectively showing a pick-up roller of an intermediate tray and portions associated therewith.
Figure 12:
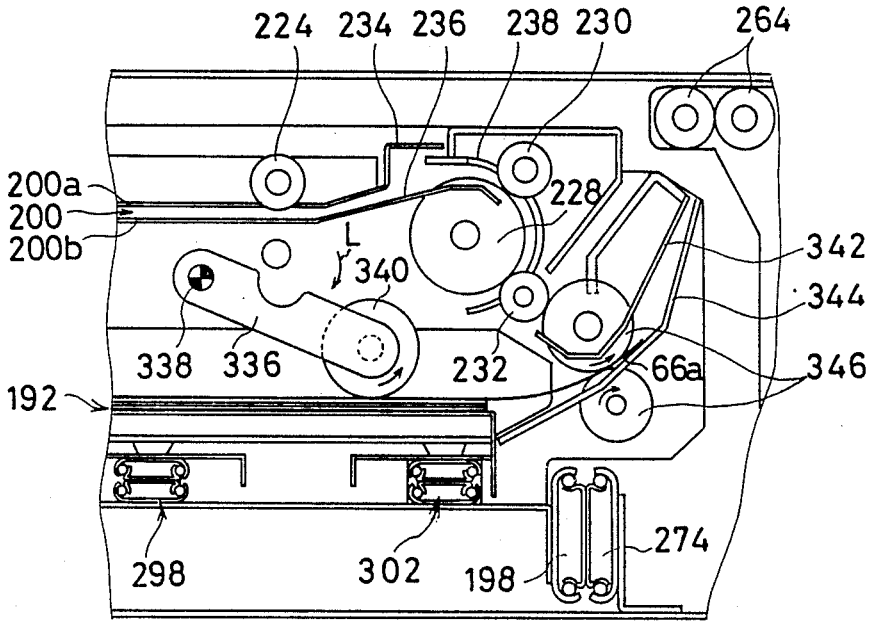

With reference to FIG. 2, FIG. 11 and FIG. 12, an arm 336 is pivotally supported by a shaft below the lower guide 200b which defines the feeding path 200 together with the aforementioned upper guide 200b. A pick-up roller 340 is attached to be rotatable at a free end of the arm 336. The arm 336 is changed in an attribute thereof in a first state where the pick-up roller 340 is positioned in the vicinity of the tip end of the guide 238, that is, an outlet of the copied paper 66a as shown in FIG. 11 or in a second state where the pick-up roller 340 is pressed against the copied paper 66a on the intermediate tray 192. In addition, the pick-up roller 340 is driven for rotation in a clockwise direction or a counterclockwise direction by a driving source (not shown). More specifically, the pick-up roller 340 is rotated in a clockwise direction when the arm 236 is in the first state or in the counterclockwise direction when the arm 336 is in the second state.

In order to make an apparatus be compact as a whole, it is not impossible to be large a gap between the pick-up roller 340 and the arm 336 in the first state or the second state. When the copied paper 66a is sent from the paper outlet of the guide 238 to the intermediate tray 192 through the feeding path 200, if the pick-up roller 340 is stopped, the copied paper 66a is caught by the pick-up roller 340, and resultingly a paper jam occurs. Therefore, in this embodiment shown, when the copied paper 66a is sent to the intermediate tray 192 through the feeding path 200, the arm 336 is changed to the first state and the pick-up roller 340 is rotated in the same direction as a feeding direction of the copied paper 66a, that is, clockwise direction. Therefore, it is avoidable a paper jam due to the above described cause.

Then, the copied paper 66a stored in the intermediate tray 192 for the double-face copy or multi-copy is sent again toward the register roller 74 by the pick-up roller 340. More specifically, the arm 336 is changed to the second state as shown in FIG. 12, and the pick-up roller 340 is rotated in a counterclockwise direction, that is, a direction of an arrow mark L. Responsively, the pick-up roller 340 is pressed against the copied paper 66a stored in the intermediate tray 192. Therefore, the copied paper 66a is sent to a path which is defined by guides 342 and 344 from the intermediate tray by the pick-up roller 340. Since a feeding roller pair 346 is provided in connection with the path, as shown in FIG. 12, the copied paper 66a is further pushed upward by the feeding roller pair 346. Then, as similar to the copying paper 66 of the above described additional cassette 256, the copied paper 66a is sent to the path defined by the guides 266 and 268, that is, the register roller 74 through the upper feeding roller pair 264. Thus, not only the copying paper 66 from the above described cassette 62 or 64 but also the copying paper 66 from the additional cassette 256 or the copied paper 66a temporarily stored in the intermediate tray 192 can be sent toward the register roller 74.

FIG. 13 is a block diagram showing a control system for this embodiment. The copying machine main unit 12 and the paper re-supplying mechanism, that is, paper supplying base 11 are respectively controlled by a microcomputer system which has MPUs 348 and 350. The microcomputer system includes ROMs 352 and 354 which is connected to the MPUs 348 and 350 and store a control program and so on, RAMs 356 and 358 which temporarily stores data for control by the MPUs 348 and 350 and have a various flag areas necessary for the control, and I/O interfaces 360 and 362 for controlling an input or output of the main unit 12 or the paper supplying base 11 by means of the MPUs 348 and 350. In addition, a D/A converter 364 for controlling an output value of an exposure voltage and so on is connected to the MPU 348 of the main unit 12. Data from a key matrix 366 of the operation panel 110 or an output of a sensor circuit 368 which includes a paper size sensor and so on is inputted to an input port of the I/O interface 360 of the main unit 12. Then, an output device 370 such as a main motor, solenoid, and so on is connected to an output port of the I/O interface 360. Especially, output voltages of the exposure lamp (light source) 28, charging corotron 46, transferring corotron 78 and separating corotron 80 and a bias voltage of a developing device 50 are set by the MPU 348 through the D/A converter 364.

A back-up circuit 372 is connected to the RAM 356 such that data written in the RAM 356 can be held even if a power switch 374 (FIG. 1) of the main unit 12 is turned off.

In addition, a servo motor controller (LSI) 376 is connected to the MPU 348 and a DC servo motor 378 for reciprocating and scanning the exposure lamp 28 is connected to an input/output terminal of the controller 376.

Then, the MPU 348 of the main unit 12 controls the paper re-supplying mechanism by sending and receiving the data between the MPU 350 of the paper re-supplying mechanism, that is, paper supplying base 11 through the I/O interfaces 360 and 362.

Figure 14:
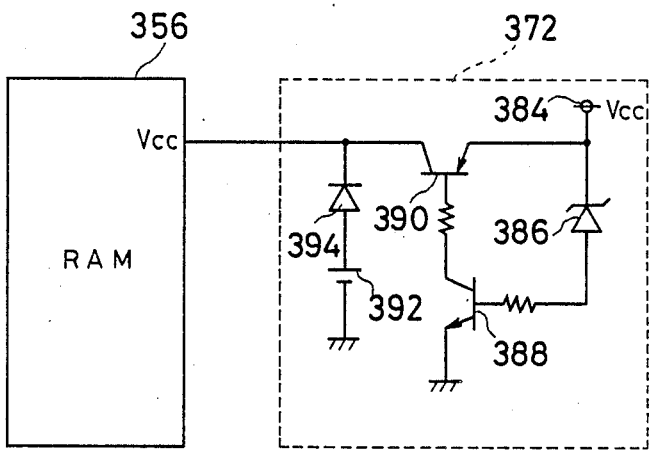
FIG. 14 is a circuit diagram showing a back-up circuit.

FIG. 14 shows a circuit diagram of the back-up circuit 372. At first, when the power switch 374 of the main unit 12 is turned on, a power source line 384 is supplied with Vcc. Then, a current flows in a base of a transistor 388 through a zener diode 386 such that the transistor 388 is turned on. Therefore, a current flows in a base of a transistor 390 and the transistor 390 becomes in a turned-on state, whereby the power source line 384 is connected to a power source terminal Vcc of the RAM 356. At the same time, a back-up battery 392 is separated from the power source line 384 by a diode 394.

When the power switch 374 of the main unit 12 is turned off, since the transistor 388 is not turned on, the transistor 390 also becomes in a turned-off state, and therefore, the power source line 384 is separated from the power source terminal Vcc of the RAM 356. At this time, the diode 394 becomes in a conductive state, and therefore, the back-up battery 392 is connected to the power source terminal Vcc of the RAM 356, whereby the data written in the RAM 356 can be held.

Figure 15A:
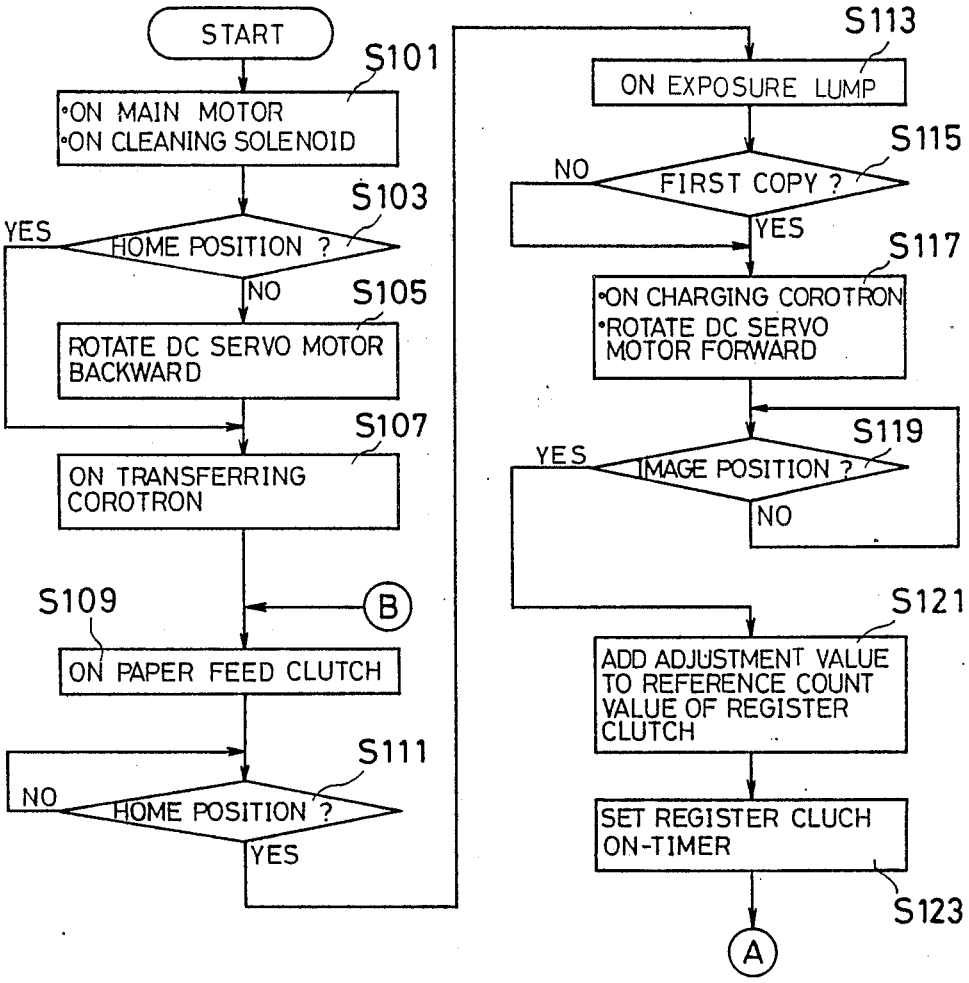
FIG. 15A and FIG. 15B are flowcharts showing a control procedure of a copying machine main unit.
Figure 15B:
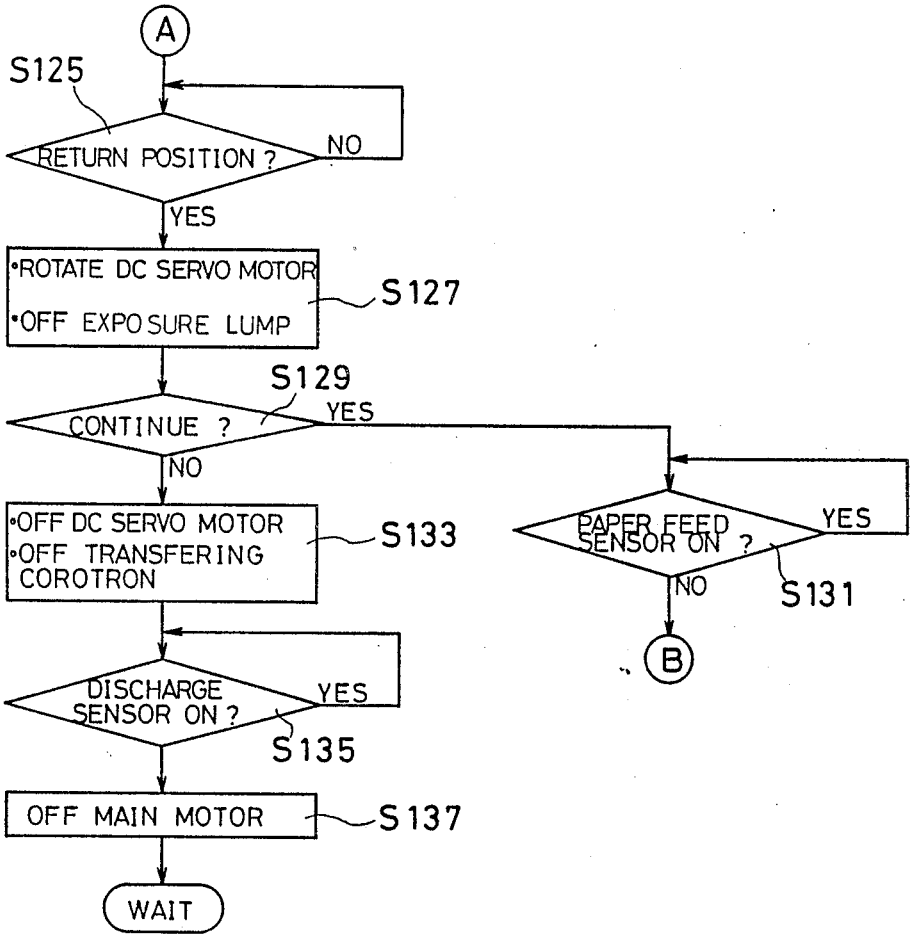

Next, with reference to FIG. 13, an operation or action of the copying machine main unit will be described based upon flowcharts as shown in FIG. 15A and FIG. 15B. At a timing when an operator first operates the power source switch 374 (FIG. 1) to turn it on, the MPU 348 initializes the I/O interface 360 and outputs setting values to the above described output device 370 based upon an adjustment data (described later) which is held in the RAM 356 through the D/A converter 364.

Next, the operator opens the automatic document feeder 16 to set the original 18 on the original table 14. Thereafter, the automatic document feeder 16 is closed such that the original 18 is fixed on the original table 14. In addition, it is possible to automatically set the original 18 by using the automatic document feeder 16. Then, the operator operates the start key 114 (FIG. 3).

When the start key 114 is operated, in the first step S101 of FIG. 15A, the main motor (not shown) for driving the photosensitive drum 38 and so on is turned on. If a rotation of the main motor becomes stable, that is, if the time of 0.5 sec lapses from a timing of the turning-on of the main motor, the solenoid of the cleaning device 84 is turned on and the tip end portion of the blade 86 is contacted with the surface of the photosensitive drum 38. In order to avoid the power source from receiving the various loads simultaneously, when a predetermined time, for example, 100 msec lapses from the turning-on of the solenoid, the process proceeds to the next step S103.

In the step S103, in view of a signal from the sensor circuit 368 (FIG. 13), the MPU 348 determines whether or not the exposure lamp 28 is in the home position, that is, whether or not the exposure lamp 28 is positioned at the left side end of the main unit 12. If the exposure lamp 28 is in the home position, the process proceeds to the next step S107 and, if not, in the step S105, the servo motor 378 (FIG. 13) is rotated in the reverse direction to return the exposure lamp 28 to the home position. The servo motor 378 is turned off by a interrupt process described later.

In the step S107, the transferring corotron 78 is turned on. After the turning-on of the transferring corotron 78, the process proceeds to the next step S109. In the step S109, first, the paper supplying clutch is turned on to start a rotation of the paper supplying roller 72 (or 258) such that a copying paper 66 is fed toward the register roller 74. On the completion of paper supply, the process proceeds to the step S111. In the step S111, it is determined whether or not the exposure lamp 28 is in the home position and, if in the home position, the process proceeds to the step S113. In the step S151, the exposure lamp 28 is turned on and, since the standup of the exposure lamp 28 is slow, after 200 msec, for example, the process proceeds to the step S115, and it is determined whether or not a first copy. If a first copy, since the standup of the exposure lamp 28 which was turned on in the previous step S113 is slow, after a stable time, for example, 300 msec, the process proceeds to the step S117.

In the step S117, the charging corotron 46 is turned on and the servo motor 378 is turned on to be rotated in the forward direction. In the next step S119, it is determined whether or not the exposure lamp 28 has been moved to an image position. If it is determined that the exposure lamp 28 reached to the image position in the step S119, the process proceeds to the next step S121.

In the step S121, a standard count value for a register clutch ON timer which is stored in advance in the ROM 352 is read, and an adjustment value for the register clutch ON timer is read from an adjustment data table which is formed in the RAM 356 such that the both is added to each other. Then, in the step S123, the register clutch ON timer within the RAM 356 is set. When the register clutch ON timer is set, after a predetermined time, the register clutch is turned on by the interrupt routine described later. A timing when the register clutch is turned on is decided by the data which is set in the register clutch ON timer, but such a timing can be changed by re-writing the adjustment data table formed in the RAM 356 in an adjustment mode described later.

On the completion of the step S123, the process proceeds to the step S125, and if it is detected that the exposure lamp 28 is moved to a returning position in the step S125, the process proceeds to the next step S127 such that the servo motor 378 is rotated in the reverse direction and the exposure lamp 28 is turned off.

In the following step S129, in view of a copy quantity counter (not shown), the MPU 348 determines whether or not the copy is to be continued. If the continuous copy, the paper sensor 76 is turned off in the next step S131, and thereafter, the process returns to the previous step S109. Therefore, the copy process after a second copy is started from the step S109.

If it is determined in the step S129 that the copy process is not to be continued, the process proceeds to the step S133 wherein the servo motor 378 which was rotated in the reverse direction in the previous step S127 is turned off. Then, after a time, for example, 200 msec when the electrostatic latent image on the photosensitive drum 38 is transferred onto a copying paper 66, the charging corotron 46 is turned off. Then, in the step S135, it is detected that the paper discharging sensor 186 is turned on by a discharging of the copied paper **66*a*, and the process proceeds to the next step S137. In the step S137, after a time, for example, 200 msec necessary for discharging the copied paper 66*a***, the main motor is turned off. Therefore, the copying machine becomes in a wait state.

Figure 16:
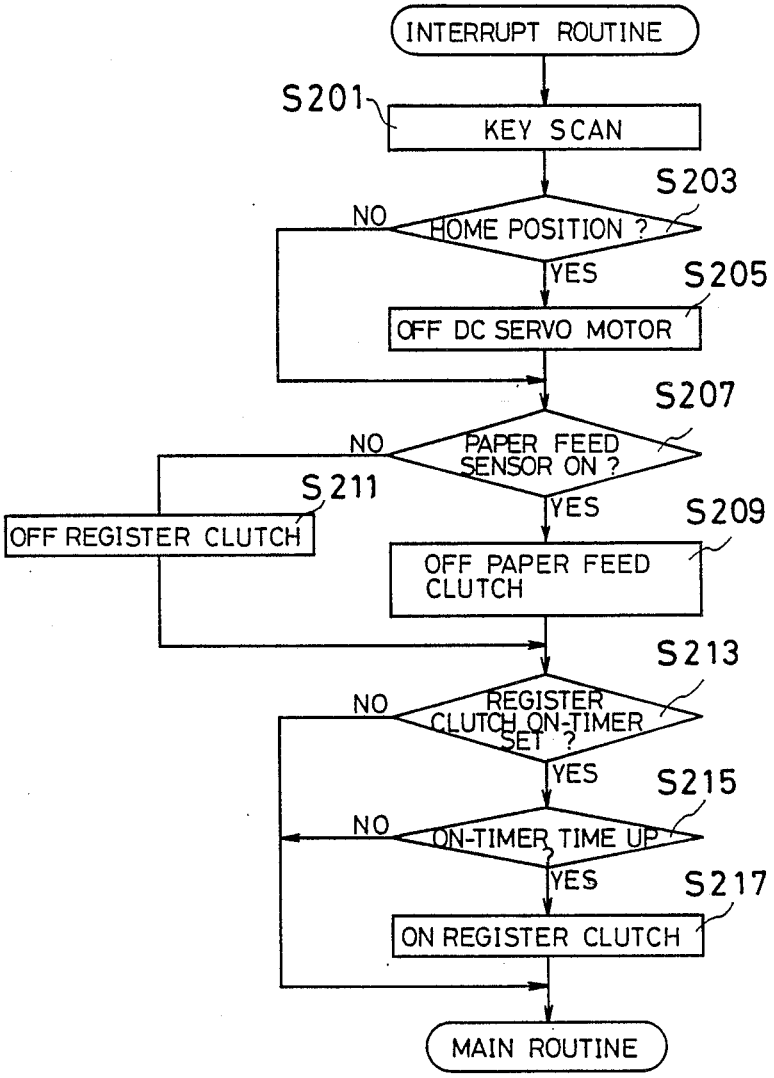
FIG. 16 is a flowchart showing an interrupt routine.

Next, with reference to FIG. 16, an interrupt routine of this embodiment will be described. The interrupt routine is executed at a predetermined time interval that is decided by an internal timer of the MPU 348. In the first step S201, the MPU 348 reads the states of a various kind of keys of the operation panel 110 from the key matrix 366 through the I/O interface 360 so as to make the process corresponding to an operated key.

In the step S203, the MPU 348 determines whether or not the exposure lamp 28 is in the home position. If not in the home position, the process proceeds to the step S207, but if in the home position, the servo motor 378 is turned off in the step S205, and thereafter, the process proceeds to the step S207.

In the step S207, it is determined whether or not the paper sensor 76 is turned on, that is, whether or not the copying paper 66 or the copied paper 66a has been fed to the register roller 74. Then, if a confirmation of the feeding of the copying paper 66 or the copied paper 66a, in the next step S209, the paper supplying clutch is turned off. Thereafter, the process proceeds to the step S213. If the preceding paper is fed, since the paper feeding sensor 76 is turned off, the MPU 348 turns the register clutch off in the next step S211, and thereafter, the process proceeds to the step S213.

In the step S213, it is determined whether or not the aforementioned register clutch ON timer is set in a timer of the RAM 356. If it is determined as "YES" in the step S213, the MPU 348, in the following step S215, determines whether or not the ON timer counts up. Then, when the register clutch ON timer counts up through the interrupt routine of any times, in the step S217, the MPU 348 turns the register clutch on. At this time point, a paper supply timing is decided so as to adjust the tip end of the image. Thereafter, as similar to the case where it is determined as "NO" in the previous steps S213 and S215, respectively, the process returns to the main routine as shown in FIG. 15A and FIG. 15B.

Figures 17A, 17B, 17C, 17D, 17E:
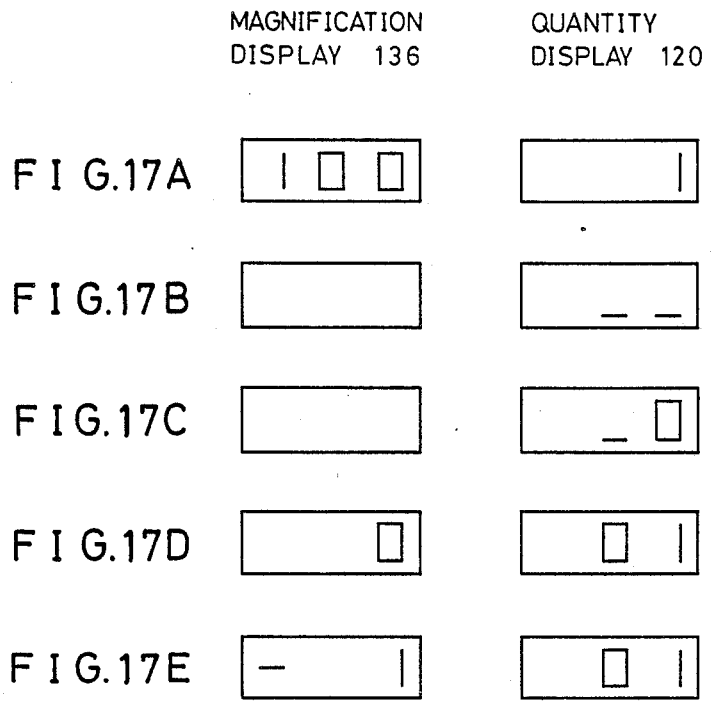
FIG. 17A–FIG. 17D are illustrative views displaying states of a quantity indicator and a magnification display of an operation panel in an adjustment mode.

Next, prior to a description of an operation of the adjustment mode, with reference to FIG. 2, FIG. 3, FIG. 13 and FIG. 17A–FIG. 17D, the adjustment mode will be described in brief. FIG. 17A–FIG. 17D are illustrative views showing displaying states of the copy quantity display 120 and the magnification display 136 of the operation panel 110. First, if the adjustment mode is set through a way described later, the magnification display 136 and the copy quantity display 120 respectively represent displays as shown in FIG. 17B. At this time, a serviceman or worker who manufactures the copying machine operates the ten-key 118 such that a numeral value of 2 digits showing the number of item which is intended to be adjusted. In this embodiment, the items of the adjustment are 8 kinds respectively corresponding to the numbers "01–08" and thus the numbers correspond to the items of the adjustment as follows; the number the item of the adjustment

| | |
|---|---|
| 01 | exposure voltage |
| 02 | charging voltage |
| 03 | developing bias voltage |
| 04 | transferring voltage |
| 05 | separating voltage |
| 06 | adjustment of tip end of image (the upper cassette 62) |
| 07 | adjustment of tip end of image (the lower cassette 64) |
| 08 | adjustment of center position of movable guide members |

The items of the adjustment shown by the numbers "01–05" are the items where the voltage is to be set by the above described D/A converter 364, the items of the adjustment shown by the numbers "06" and "07" is the adjustment of the register clutch ON timer, and the item of the adjustment shown by the number "08" is the adjustment of the center position of the movable guide members 392 and 394 of the intermediate tray 192. A standard of each adjustment value is "0" and an adjustment range of plus (+) or minus (−) is decided. More specifically, a standard output data of the D/A converter 364, a standard count value, that is, the number of output pulses for the register clutch ON timer is stored in the ROM 352 in advance and, in using such data, the adjustment data corresponding to the item to be adjusted is read from the RAM 356 and added to the standard value such that the output of the D/A converter 364 or the number of pulses for the register clutch ON timer is set. In addition, the adjustment data is saved in the RAM 356 as the adjustment data table in the order of the number of the item.

FIG. 17C is a display state when "0" is inputted by the ten-key 118 and, if "1" is further inputted by the ten-key 118, the display as shown in FIG. 17D is performed. At this time, on the magnification display 136, the adjustment data which is presently stored in the RAM 356 for the adjustment item corresponding to the number "01", that is, the exposure voltage is displayed.

Next, the operator changes the adjustment data on the magnification display 136 by depressing the zoom key 134a. For example, if the adjustment data is reduced by "1" by operating the zoom key 134a once in the state where the display as shown in FIG. 17D is performed, the display becomes as shown in FIG. 17E, and at the same time, a starting data of the adjustment data table within the RAM 356 is reduced by "1", and therefore, "−1" is added to the standard data for the exposure voltage in the ROM 352 and a result thereof is outputted as an analog data from the D/A converter 364.

Now, if the operator depress the start key 114, a copy process shown in FIG. 15A and FIG. 15B is performed experimentally. Therefore, the operator adjusts by repeating the above described operation while the operators views the image obtained by the experimental copying process. Then, if it is desired to change the adjustment item, if the operator inputs the number of a new adjustment item in the displaying state of FIG. 17D or FIG. 17E through an operation of the ten-key 118, the copy quantity display 120 and the magnification display 136 are immediately changed to the displaying state of FIG. 17C or FIG. 17D.

In addition, the clear/stop key 121 is depressed in the displaying state of FIG. 17C–FIG. 17E, the displaying state of FIG. 17B is performed and, if the clear key 121 further depressed, the displaying state returns to that of FIG. 17A. Furthermore, the number capable of being inputted by the ten-key 118 for the copy quantity display 120 is only one of "01–08" and the other number is rejected to be received.

Figure 18A:
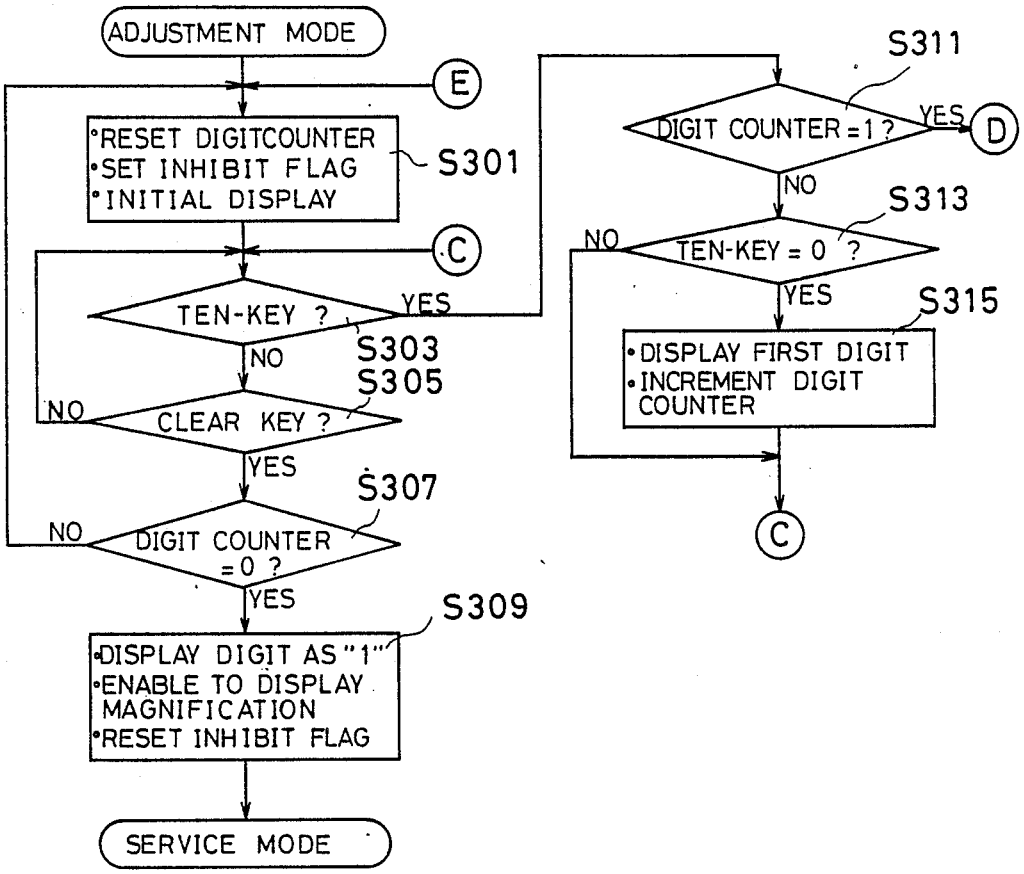
FIG. 18A and FIG. 18B are flowcharts showing an adjustment mode.
Figure 18B:
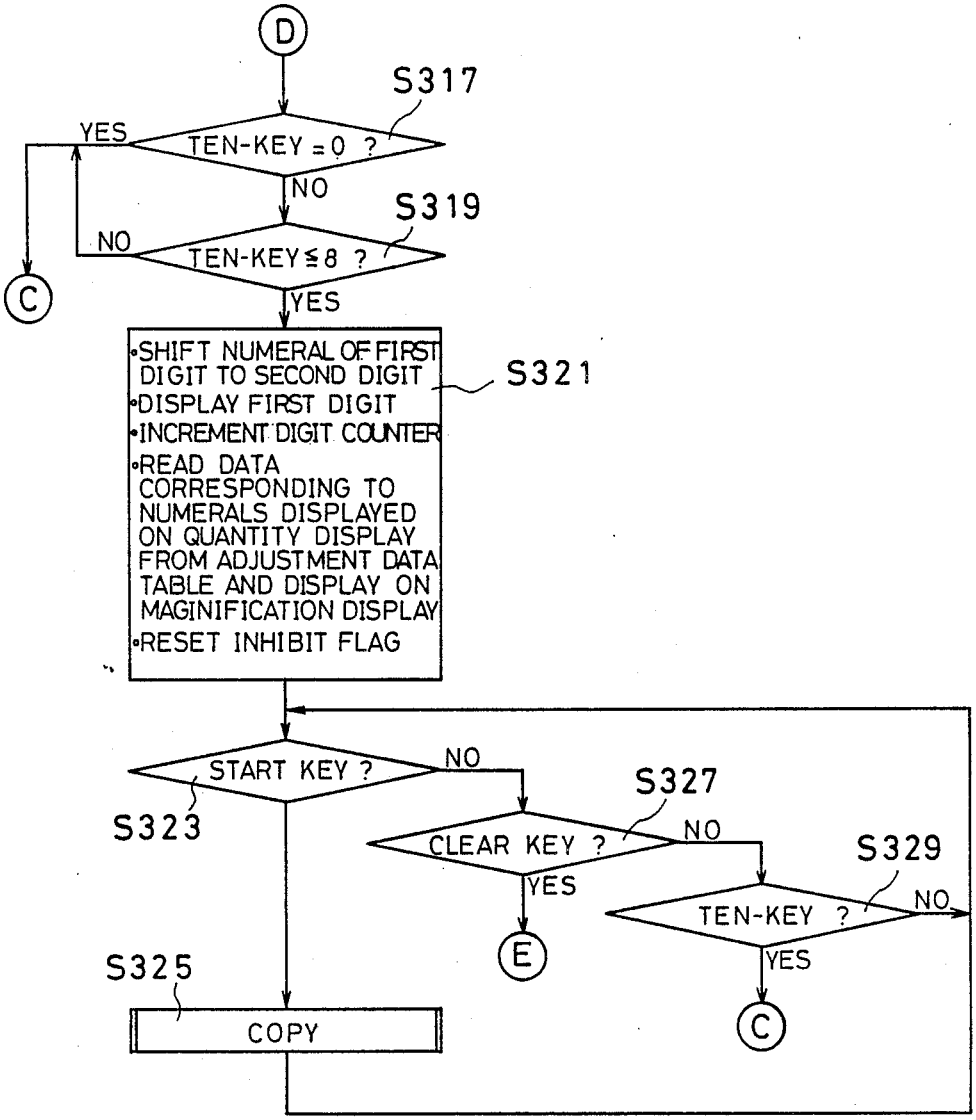

Next, based upon flowcharts showing an adjustment mode in FIG. 18A and FIG. 18B, a method or operation for adjustment by inputting the numeral value through the ten-key 118.

First, the serviceman operates the power source switch 374 (FIG. 1) to turn the power source on after the turning-on of a service switch (not shown). Responsively, the copying machine main unit 12 becomes in the service mode and the displaying states of the magnification display 136 and the copy quantity display 120 become as shown in FIG. 17A. Now, if the serviceman inputs "99", for example, by the ten-key 118 and depresses the start key 114, the adjustment mode is entered and the displaying states become as shown in FIG. 17B. However, the numeral value which is inputted to enter the machine into the adjustment mode is not necessary "99" and a suitable numeral value may be decided in advance.

If the process enters to the adjustment mode, first, in the step S301, a digit number counter (not shown) is reset to be "0". The digit number counter is a counter formed in the RAM 356 and used for storing the number of digits which is displayed on the copy quantity display 120a in the adjustment mode. In other words, the digit number counter is used for determining whether the present displaying state is equal to any one of FIG. 17B–FIG. 17D. Then, by setting a zoom key inhibiting flag, the zoom key 134a is inhibited from being received by a key scanning operation in the step S201 of FIG. 16. Such inhibition is for avoiding an erroneous display on the magnification display 136 when the displaying state thereof is as shown in FIG. 17B or FIG. 17C.

Thereafter, the displaying states of the magnification display 136 and the copy quantity display 120 are changed to the initial displaying state (FIG. 17B), and the process proceeds to the step S303. In the step S303, it is determined whether or not the ten-key 118 is operated and, if not operated, the process proceeds to the step S305 wherein it is determined whether or not the clear key 121 is depressed. At this time, if the clear key 121 is not depressed, the process is returned to the step S303, but in the case where the clear key 121 is depressed, the process proceeds to the step S307 wherein it is determined whether or not the digit number counter is "0". If "0", since the present displaying state is the initial displaying state (FIG. 17B) of the adjustment mode, the displaying state is returned to the state of FIG. 17A in the step S309 and the zoom key inhibiting flag is reset, and thereaftr, the process returns to a normal service mode.

If the digit number counter is not "0" in the step S307, it is determined that the present displaying states are as shown in FIG. 17C or FIG. 17D such that the process returns to the step S301 of the initial state of the adjustment mode.

In the case where it is determined that the ten-key 118 is operated in the step S303, the process proceeds to the step S311 wherein it is determined whether or not the digit number counter is "1", that is, whether or not the present displaying states are as shown in FIG. 17C. If "NO" is determined, since the displaying states are as shown in FIG. 17B or FIG. 17D, in the next step S313, it is determined whether or not the operated ten-key is "0" and, if "YES" is determined in the step S313, in the step S315, "0" is displayed on the copy quantity display 120 and the digit number counter is set as "1", and thereafter the process returns to the step S303. In the case where "NO" is determined in the step S313, since the numeral value is not within the range of the numbers "01–08", the process returns to the step S303 with no operation.

In the case where "YES" is determined in the step S311, since the displaying states are as shown in FIG. 17C, in the step S317, it is determined whether or not the operated ten-key is "0". If "YES" is determined in the step S317, the process returns to the step S303 without receiving "0". In the case where "NO" is determined in the step S317, the display of the first digit is "1", and therefore, the numeral value capable of being received succeedingly is only any one of "1–8", in the step S319, it is determined whether or not the operated ten-key is "8" or less and, if "YES", the process proceeds to the step S321 and, if "NO", the process returns to the step S303.

In the step S321, first, the display of the first digit is shifted to the second digit such that the numeral value which has been just inputted by the ten-key 118 is displayed on the first digit, and the digit number counter is incremented as "2". Then, the data corresponding to the number displayed on the copy quantity display 120 is read from the adjustment data table of the RAM 356 to be displayed on the magnification display 136 (FIG. 17D). Thereafter, since the zoom key inhibiting flag is reset, the zoom key 134a is allowed to be received through the key scanning operation of the step S201 in FIG. 16.

Next, in the step S323, it is determined whether or not the start key 114 is depressed. In the case of "YES", the copy process as shown in FIG. 15A and FIG. 15B is executed in the step S325, and thereafter, the process returns to the step S332. In the case of "NO", the process proceeds to the step S327 wherein it is determined whether or not the clear key 121 is depressed. In the case where "YES" is determined in the step S327, the process returns to the step S301, that is, the initial state of the adjustment mode. If "NO" is determined in the step S327, the process proceeds to the step S329 wherein it is determined whether or not the ten-key 118 is operated and, if "YES", the process returns to the step S303 and, in the case of "NO", the process returns to the step S323.

Next, based upon flowcharts as shown in FIG. 19A, FIG. 19B, FIG. 20 and FIG. 21, an operation or action of the paper supplying base 11 will be described.

First, the operator puts the original 18 on the original table 14 in the state where the surface of the original 18 on which an image intended to be copied on a first surface of a copying paper 66 is faced downward. Next, the operator operates the start key 114 after an operation of the double-face copy key 162a or 162b, or the multi-copy key 164 of the operation panel 110.

When the copy process is entered, a signal notifying that the double-face copy or multi-copy is designated is outputted from the output port of the I/O port 360 of the main unit shown in FIG. 13, and the signal is received by the MPU 350 of the paper supplying base 11 through the I/O port 362. The MPU 350 always waits a signal from the main unit while the steps S401, 403, 405 and 407 are cyclically executed.

The steps S401–S407 show a state of paper supplying from the addition cassette insertion portion 254 and, a signal indicating a start to supply a copying paper from the additional cassette 256 is detected, the paper supplying clutch is turned on to rotate the paper supplying roller 258, whereby the copying paper 66 within the cassette 256 is sent to the register roller 74 in the copying machine main unit 12 through the intermediate roller 264. Then, on the turning-on of the paper sensor 76, a rotation of the paper supplying roller 258 is stopped.

If the MPU 350 detects a starting signal of the double-face copy in the step S411 through the step S409, process proceeds to the next step S413 wherein the claw 172 of the direction changing portion 168 is changed to the arrow mark direction B so as to guide the copied paper 66a to the intermediate tray 192. Then, the MPU 350 receives the paper size data from the main unit 12 through the I/O port 362, and in response thereto, the MPU 350 turns the solenoid included in the output device 382 on such that one of the stoppers 324–330 is set or stood up. At the same time, the main motor included in the same output device 382 is rotated in the forward direction. Responsively, the feeding rollers 170, 180, 202, 204, and 216–224 are started to rotate. In addition, as shown in FIG. 11, the pick-up roller 340 is rotated in a clockwise direction.

If in the case of the multi-copy, in the step S417 through the step S415, instead of the setting of the stoppers 324–330, the solenoid included in the output device 382 is turned on such that one of the claws 240–248 can be set or stood up.

Then, after the step S413 or S417, in the step S419, the stepping motors 312 and 314 (FIG. 9) included in the output device 382 are driven such that the movable guide members 292 and 294 can be moved to a position of a width of the paper size at that time so as to align the both side ends of the copied paper 66*a* which is sent into the intermediate tray 192. In addition, as described above, in the case of the double-face copy, the copied paper 66*a* is stacked in the intermediate tray 192 through the feeding path 200 and, in the case of the multi-copy, the copied paper 66*a* is stacked as it is in the intermediate tray 192 by changing the path of the paper by means of any one of the claws 240–248.

When the movable guide members 392 and 394 are moved to the position for the width of the paper size at that time, in the step S421, a paper counter which is formed in the RAM 358 and counts the number of the sheets of the copied papers 66*a* stored in the intermediate tray 192 is cleared as "0".

If it is detected that the copied paper 66*a* has been stored in the intermediate tray 192 in the step S423, in the step S425, the paper counter is incremented and, in the step S427, it is determined whether or not the number of sheets of the copied paper 66*a* stored in the intermediate tray 192 becomes ten (10). In other words, the value of the paper counter is compared with "10". If the value of the paper counter is not "10" the process proceeds to the step S429 wherein the alignment of the both side ends of the copied paper 66*a* is performed by the movable guide members 292 and 294. Thereafter, in the step S431, it is determined whether or not the copied paper which has just been stored is the last copied paper. Such a determination of the last copied paper can be performed by the MPU 350 in accordance with a signal being sent from the MPU 348 of the main unit 12 through the I/O ports 360 and 362.

When "NO" is determined in the step S431, the process returns to the step S423 and, in the case where "YES" is determined in the step S431, the process proceeds to the step S433 wherein a rotation of the feeding rollers which were previously turned on is stopped and the claw 172 of the direction changing portion 168 is returned to the arrow mark direction A. Then, the process returns to the step S401 wherein a signal from the main unit 12 is waited.

When it is detected in the step S427 that the value of the paper counter is "10", in the step S435, it is determined whether or not it is the last copied paper. If the last copied paper, the process proceeds to the step S433. If not the last copied paper, the process proceeds to the step S437 wherein the movable guide members 292 and 294 are returned to the home positions, respectively by a way described later. Then, the process returned to the step S419, the movable guide members 292 and 294 are moved again to the positions corresponding to the width of the paper size from the home positions. Thus, the both side ends of the copied paper are aligned for each copied paper by the movable guide members 292 and 294 and, for every 10 copied papers 66*a*, the returning to the home positions and the movement to the positions corresponding to the width of the paper size of the movable guide members 292 and 294 are repeated.

Figure 19A:
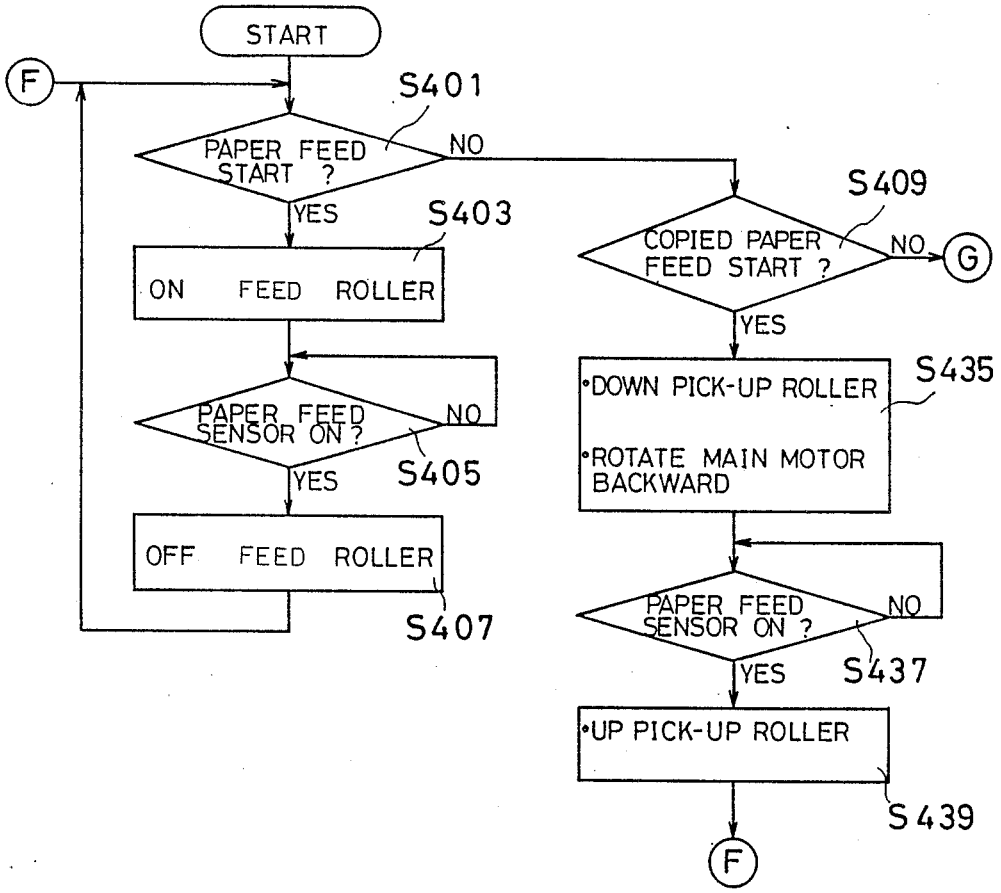
FIG. 19A and FIG. 19B are flowcharts showing a control procedure for supplying a copied paper.
Figure 19B:
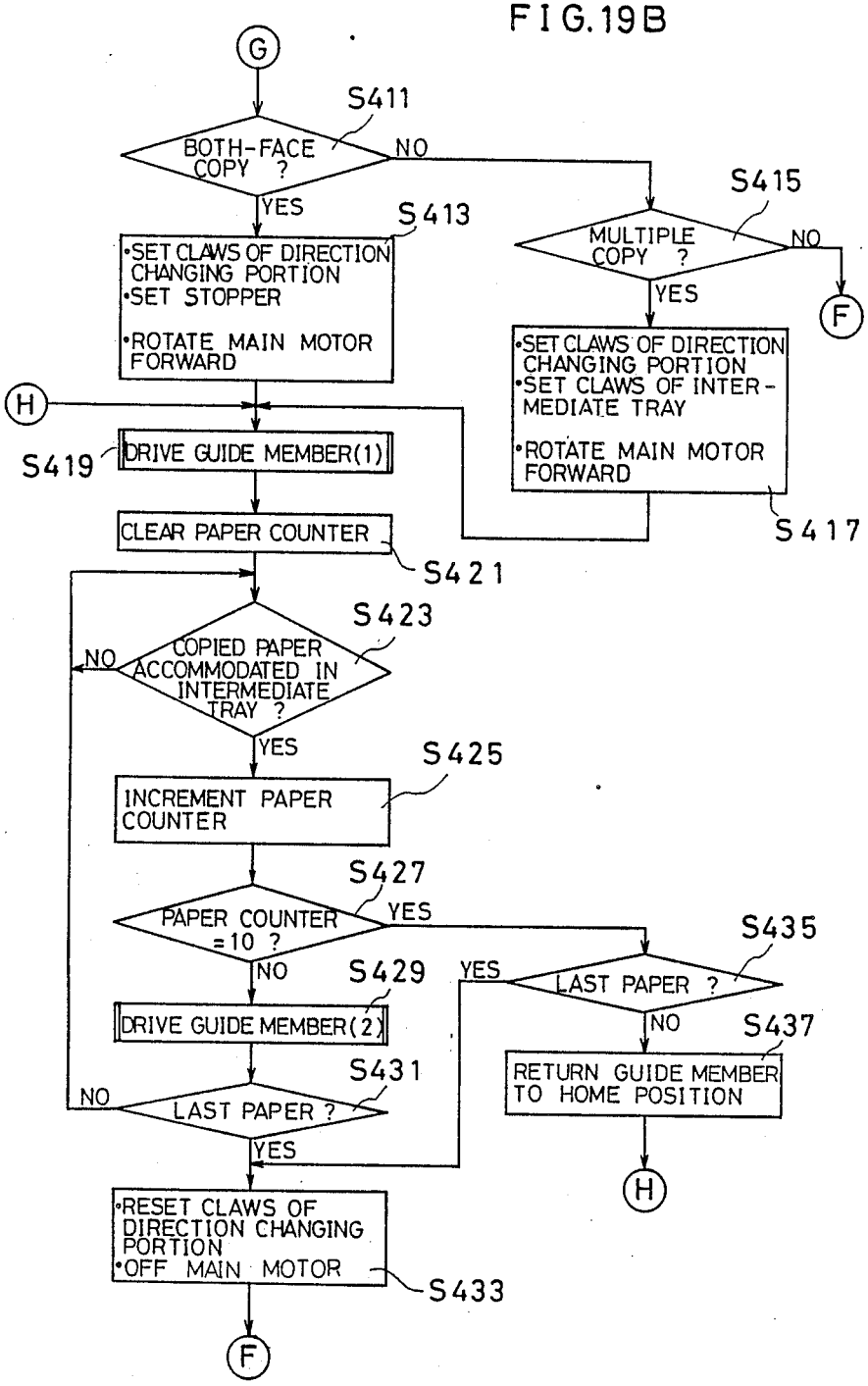
Figure 20:
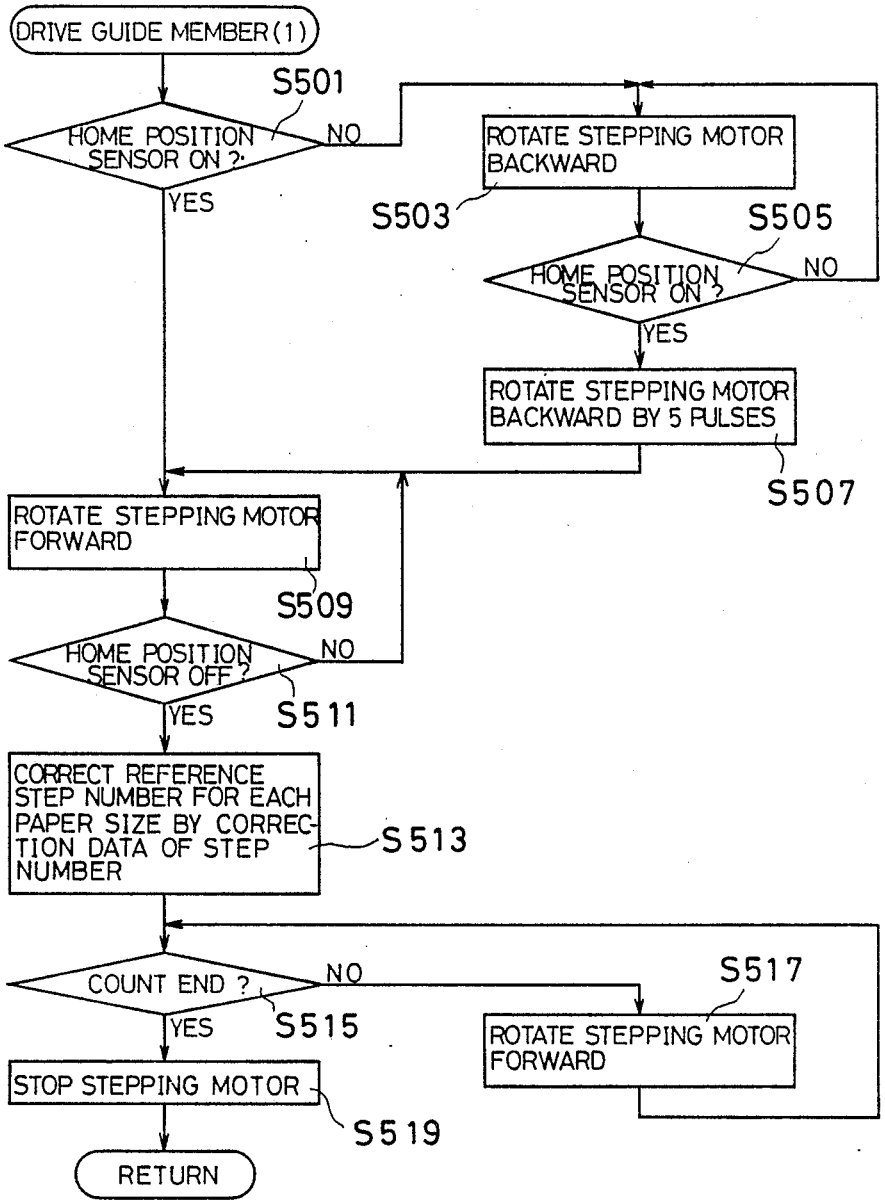
FIG. 20 and FIG. 21 are flowcharts respectively showing different moving actions of a movable guide member.

Now, with reference to FIG. 20, in the case of the drive movable guide member (1) of the step S419 in FIG. 19B, in the step S501, the MPU 350 is determined whether or not the home position sensors 320 and 322 (FIG. 7 and FIG. 9) which are included in the sensor circuit 380 and for the movable guide members 392 and 394 are turned on. In the case of "NO", in the step S503, the MPU 350 rotates the stepping motors 312 and 314 (FIG. 9) included in the output device 382 in a reverse direction. Responsively, the movable guide members 292 and 294 are moved in a direction where the both are apart from each other. Then, when the home position sensors 320 and 322 are turned on in the step S505, in the step S507, the stepping motors 312 and 314 are further rotated in the reverse direction by 5 pulses, and thereafter, the stepping motors 312 and 314 are turned off, and the process proceeds to the step S509.

On the other hand, when it is detected in the step S501 that the movable guide members 292 and 294 have been in the home positions, the process immediately proceeds to the step S509.

In the step S509, the stepping motors 312 and 314 are rotated in the forward direction. Therefore, the movable guide members 292 and 294 are moved in a direction where the both are closed to each other. Then, when it is detected in the step S11 that the home position sensors 320 and 322 are turned off, process proceeds to the step S513. In addition, the positions of the movable guide members 292 and 294 at a timing when the home position sensors 320 and 322 are turned off are the reference positions, that is, actual home positions of the movable guide members 292 and 294.

In the step S513, the MPU 350 corrects the reference step number for each paper size stored in advance in the ROM 354 in accordance with the adjustment data of the step number which is held in the RAM 356 of the main unit 12 and read through the I/O interfaces 360 and 362. Thereby, an actual center position between the movable guide members 292 and 294 can be corrected. More specifically, as to the stepping motor 312 of the movable guide member 292, the adjustment data of the step number is added to the step number to the reference position, that is, the data of the reference position and, as to the stepping motor 314 of the other movable guide member 294, the adjustment data is subtracted from the reference position data. Thus, the stepping motors 312 and 314 are respectively rotated in the forward direction in the step S517 until it is detected in the step S515 that the correction of the center position between the movable guide members 292 and 294 is completed. Then, when it is detected in the step S515 that the correction of the center position has been completed, the stepping motors 312 and 314 are stopped in the step S519.

Figure 21:
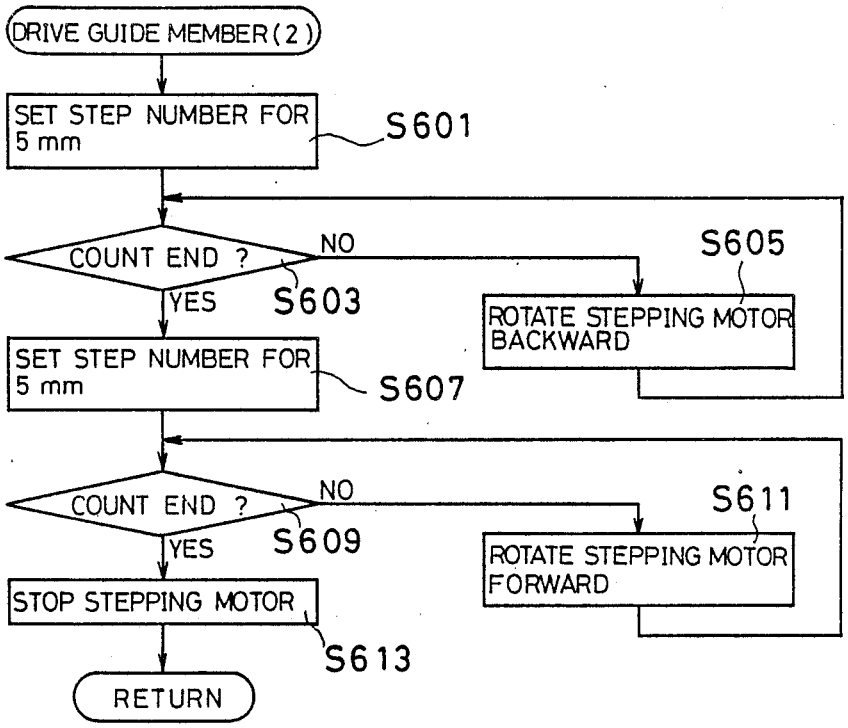

Next, with reference to FIG. 21, an action for a width alignment of the step S429 in FIG. 19B. In this case, since the movable guide members 292 and 294 originally exist at positions equal to the paper size, it is not necessary to return the same to the home positions, and the movable guide members 292 and 294 may be moved within a distance necessary for aligning the copied paper 66*a* which is stored in the intermediate tray 192. Then, the step number for 5 mm is set in the step S601. In the step S603, the stepping motors 312 and 314 are rotated in the reverse direction such that the movable guide members 292 and 294 are moved to be apart from each other until it is detected that the movable guide members 292 and 294 are moved by 5 mm. Then, the step number for 5 mm is set again in the step S607 and, until the movement of 5 mm is detected in the step S609, in the step S611, the stepping motors 312 and 314 are rotated in the forward direction such that the movable guide members 292 and 294 are moved to be closed to each other. Then, in the step S613, the stepping motors 312 and 314 are turned off.

Returning to FIG. 19B, when the storing of the copied paper 66a into the intermediate tray 192 is completed, the operator changed the original 18 such that a second surface (or the same surface) can be copied, and then, operates again the start key 114. When the copying process is started for the second surface (or the same surface), the MPU 348 of the main unit 12 outputs a start signal for supplying the copied paper from the output port of the I/O interface 360.

If the MPU 350 of the paper supply base 11 receives the signal through the I/O interface 362 in the step S409, in the step S435, the MPU 350 turns the solenoid included in the output device 382 on, and therefore, as shown in FIG. 12, the pick-up roller 340 is fallen so as to contact with the copied paper 66a within the intermediate tray 192. At this time, the MPU 350 rotates the main motor in the reverse direction such that the pick-up roller 340 can be rotated in the counterclockwise direction. Thereby, the uppermost copied paper in the intermediate tray 192 is picked-up one by one and sent through the driving roller 346 and the intermediate roller 264 (FIG. 12) toward the register roller 74. When it is confirmed in the step S437 that the paper sensor 76 is turned on, in the step S439, the pick-up roller 340 is raised in the state as shown in FIG. 11 and the main motor of the paper supply base 11 is stopped in synchronous with the main motor of the main unit 12. Therefore, the rotation of the pick-up roller 340 and the other rollers are stopped.

Thereafter, an operation after the step S111 in FIG. 15A is executed.

In addition, in the embodiment, as a time counting means which accumulates a time of the reciprocated action of the movable guide members 392 and 394 for aligning the both side ends (width) of the copied paper, a counter for counting the number of the sheet of the copied paper which is received in the intermediate tray 192, and at every timing when the count number of the paper counter reaches a predetermined number, the movable guide members 392 and 394 are forcedly returned to the reference positions (home positions) and thereafter, the position correction are made such that the movable guide members 392 and 394 are moved again from the home positions to the positions equal to the width of the predetermined paper size. However, instead of such a paper number counter, a timer may be used. More specifically, a time of the reciprocated action for each copied paper is accumulated and the position correction is made at every predetermined time, or the number of the reciprocated action of the movable guide members 392 and 394 is counted and the position correction is made at every timing when the counted value reaches a predetermined number.

Although the present invention has been described and illustrated in detail, it is clearly understood that the same is by way of illustration and example only and is not to be taken by way of limitation, the spirit and scope of the present invention being limited only by the terms of the appended claims.

WHAT IS CLAIMED IS

1. An imaging forming apparatus, comprising:

image forming means;

first paper supplying means for supplying a copying paper to said image forming means;

an intermediate tray for temporarily storing a copied paper on which an image has been formed by said image forming means;

second paper supplying means for supplying again the copied paper from said intermediate tray to said image forming means;

two movable guide members provided in association with said intermediate tray for aligning both side ends of the copied paper stored in the intermediate tray;

moving means for moving each of said movable guide members in a direction of a width of said copied paper; and center position changing means for changing a center position between said two movable guide members in a width direction of said copied paper.

2. An image forming apparatus in accordance with claim 1, wherein said center position changing means includes means for moving said two movable guide members in the same direction at the same amount.

3. An image forming apparatus in accordance with claim 2, further comprising input means for inputting data for correcting divergence of the center position between said two movable guide members, wherein said center position changing means includes changing means for changing reference positions of said two movable guide members in accordance with the data inputted by said input means.

4. An image forming apparatus in accordance with claim 3, wherein said moving means includes a motor for applying a driving force for moving respective one of said guide members, and motor driving means for driving said motor based upon the data being applied, and said changing means includes data correction means for correcting the data of said reference positions such that the reference positions of said two movable guide members can be shifted in the same direction at the same amount.

5. An image forming apparatus in accordance with claim 4, further comprising home position sensors for sensing home positions of said two movable guide members, wherein said data of said reference positions are data in association with a distance from said home positions to said reference positions, respectively.

6. An image forming apparatus in accordance with claim 4, wherein said motor includes a stepping motor, and said data includes the pulse number or the step number for driving said stepping motor.

7. An image forming apparatus in accordance with claim 1, wherein said moving means includes moving means for moving said two movable guide members in a reciprocated manner between a first position and a second position such that said two movable guide members can be pressure-contacted with the both side ends of the copied paper stored in said intermediate tray.

8. An image forming apparatus in accordance with claim 7, further comprising position deciding means for deciding said first position and said second position in accordance with a size of said copied paper, wherein said two movable guide members are moved from respective home positions to said first position or second position decided by said position deciding means.

9. An image forming apparatus in accordance with claim 8, further comprising returning means for forcedly returning said two movable guide members to said respective home positions when copied papers of a predetermined number have been stored in said intermediate tray.

10. An image forming apparatus, comprising:
image forming means;
first paper supplying means for supplying a copying paper to said image forming means;
an intermediate tray for temporarily storing a copied paper on which an image has been formed by said image forming means;
second paper supplying means for supplying again the copied paper from said intermediate tray to said image forming means;
two movable guide members provided in association with said intermediate tray for aligning both side ends of the copied paper stored in said intermediate tray;
adjustment data input means for inputting an adjustment data for adjusting a center position between said two movable guide members in a direction orthogonally intersecting a feeding direction of said copied paper;
storing means for storing data inputted by said adjustment data input means; and
reference position changing means for changing reference positions of said two movable guide members in accordance with the data stored in said storing means such that said center position of the copied paper in said intermediate tray can be changed.

11. An image forming apparatus, comprising:
image forming means;
first paper supplying means for supplying a copying paper two said image forming means;
an intermediate tray for temporarily storing a copied paper on which an image has been formed by said image forming means;
two movable guide members provided in association with said intermediate tray for aligning both side ends of the copied paper stored in said intermediate tray;
first moving means for moving said two movable guide members from respective home positions to reference positions;
second moving means for moving said two movable guide members from said reference positions in a direction of the both side ends of said copied paper at every timing when said copied paper is stored in said intermediate tray; and
returning means for forcedly returning said two movable guide members to said respective home positions at every timing when a predetermined time lapses.

12. An image forming apparatus in accordance with claim 11, wherein said returning means forcedly returns said two movable guide members to said respective home positions at every timing when copied papers of a predetermined number of two or more are stored in said intermediate tray.

13. An image forming apparatus in accordance with claim 11, wherein said returning means forcedly returns said two movable guide members to said respective home positions at every timing when the number of times of the movement of said two movable guide members by means of said second moving means reaches a predetermined number of times.

14. An image forming apparatus, comprising:
image forming means;
paper supplying means for supplying a copying paper to said image forming means;
discharging means for discharging a copied paper on which an image has been formed by said image forming means;
an intermediate tray for temporarily storing said copied paper;
a direction changing portion for changing a sending direction of said copied paper such that said copied paper can be sent to said discharging means or said intermediate tray; and
first supporting means for supporting said direction changing portion to be movable in a discharging direction of said copied paper.

15. An image forming apparatus in accordance with claim 14, wherein said direction changing portion includes a guide plate for defining a path of the copied paper to said discharging means and a path of the copied paper to said intermediate tray, said guide plate is pivotally supported at an end thereof in a discharging direction of the copied paper, whereby said guide plate is constructed to be opened at an opposite end thereof.

16. An image forming apparatus in accordance with claim 15, wherein said direction changing portion includes path selecting means provided at an upstream side in a feeding direction of the copied paper from the path of the copied paper to said discharging means and the path of the copied paper to said intermediate tray, and for selecting the paths.

17. An image forming apparatus in accordance with claim 14, further comprising a paper supplying base for supporting said intermediate tray; and further paper supplying means provided on said paper supplying base for supplying a copying paper to said image forming means.

18. An image forming apparatus in accordance with claim 17, further comprising second supporting means for supporting said paper supplying base to be movable in a direction orthogonally intersecting a feeding direction of said copied paper toward said intermediate tray.

19. An image forming apparatus in accordance with claim 17, further comprising a feeding roller for feeding the copied paper from said intermediate tray or the copying paper from said further paper supplying means to said image forming means.

20. An image forming apparatus in accordance with claim 19, further comprising third supporting means for supporting said further paper supplying means to be movable in an opposite direction to the feeding direction of said copying paper with respect to said paper supplying base.

21. An image forming apparatus in accordance with claim 18, further comprising a feeding path for feeding the copied paper from said direction changing portion to said intermediate tray, said feeding path being defined by an upper and lower guide plates which can be opened with each other.

22. An image forming apparatus in accordance with claim 21, further comprising fourth supporting means for supporting said lower guide plate to be opened or closed with respect to said intermediate tray.

23. An image forming apparatus, comprising:
image forming means;
paper supplying means for supplying a copying paper to said image forming means;
an intermediate tray for temporarily storing a copied paper on which an image has been formed by said image forming means;

a feeding path for guiding said copied paper to said intermediate tray;

feeding rollers provided in said feeding path at a predetermined interval in a feeding direction of said copied paper; and claws respectively provided at the downstream side of respective feeding rollers, each of said claws being selectively changed to a first position for allowing the copied paper to be fed in said feeding path or a second position for directly sending the copied paper to said intermediate tray.

24. An image forming apparatus in accordance with claim 23, wherein said claws are provided positions equal to different paper sizes.

25. An image forming apparatus in accordance with claim 24, further comprising a pick-up roller which is provided in association with said intermediate tray and takes a first position in the vicinity of an outlet of said feeding path or a second position wherein said pick-up roller is pressure-contacted with the copied paper on said intermediate tray;

first rotating means for rotating said pick-up roller in a direction that the copied paper can be fed to said intermediate tray when said pick-up roller exists at said first position; and second rotating means for rotating said pick-up roller in a direction that the copied paper can be withdrawn from said intermediate tray when said pick-up roller exist at said second position.

26. An image forming apparatus, comprising:

image forming means;

paper supplying means for supplying a copying paper to said image forming means;

an intermediate tray for temporarily storing a copied paper on which an image has been formed by said image forming means;

a feeding path for guiding the copied paper to said intermediate tray;

a pick-up roller which is provided in association with said intermediate tray and takes a first position in the vicinity of an outlet of said feeding path or a second position wherein said pick-up roller is pressure-contacted with the copied paper on said intermediate tray;

first rotating means for rotating said pick-up roller in a direction that the copied paper enters in said intermediate tray when said pick-up roller exists at said first position; and second rotating means for rotating said pick-up roller in a direction that the copied paper comes out from said intermediate tray when said pick-up roller exists at said second position.

* * * * *